US011372366B2

(12) United States Patent
Sato et al.

(10) Patent No.: US 11,372,366 B2
(45) Date of Patent: Jun. 28, 2022

(54) IMAGE-FORMING APPARATUS INCLUDING MOVABLE DRAWER ON WHICH TONER CARTRIDGE IS MOUNTABLE WITHOUT PROCESS CARTRIDGE

(71) Applicant: Brother Kogyo Kabushiki Kaisha, Nagoya (JP)

(72) Inventors: Shougo Sato, Seto (JP); Daisuke Maeta, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/950,147

(22) Filed: Nov. 17, 2020

(65) Prior Publication Data

US 2021/0191311 A1 Jun. 24, 2021

(30) Foreign Application Priority Data

Dec. 24, 2019 (JP) ..... JP2019-232607

(51) Int. Cl.
*G03G 21/18* (2006.01)

(52) U.S. Cl.
CPC ..... *G03G 21/1842* (2013.01); *G03G 21/1814* (2013.01)

(58) Field of Classification Search
CPC ..... G03G 21/1814; G03G 21/1842; G03G 21/1835; G03G 21/1864; G03G 21/1871
See application file for complete search history.

(56) References Cited

U.S. PATENT DOCUMENTS

| | | | | |
|---|---|---|---|---|
| 10,606,210 | B2 * | 3/2020 | Nosho | G03G 21/1676 |
| 2006/0067734 | A1 * | 3/2006 | Igarashi | G03G 21/1821 399/119 |
| 2010/0080615 | A1 | 4/2010 | Kikuchi | |
| 2011/0164897 | A1 | 7/2011 | Kikuchi | |
| 2011/0182612 | A1 * | 7/2011 | Kamimura | G03G 21/1676 399/110 |
| 2011/0182613 | A1 * | 7/2011 | Kamimura | G03G 15/0178 399/110 |
| 2011/0217068 | A1 * | 9/2011 | Kamimura | G03G 15/0872 399/110 |
| 2017/0285571 | A1 * | 10/2017 | Takahashi | G03G 21/1647 |

(Continued)

FOREIGN PATENT DOCUMENTS

| | | |
|---|---|---|
| JP | 2011-186067 A | 9/2011 |
| JP | 2015-031865 A | 2/2015 |

(Continued)

*Primary Examiner* — Francis C Gray
(74) *Attorney, Agent, or Firm* — Burr & Brown, PLLC

(57) ABSTRACT

An image-forming apparatus includes: a main casing; a drawer movable in a first direction relative to the main casing; a process cartridge detachably mountable on the drawer; and a toner cartridge detachably mountable on the drawer. The drawer is movable between: an inner position where the drawer is accommodated in the main casing; and an outer position where a part of the drawer is located outside the main casing. The process cartridge includes: a photosensitive drum rotatable about an axis extending in a second direction crossing the first direction when the process cartridge is mounted on the drawer; and a developing device configured to supply toner to the photosensitive drum. The toner cartridge is configured to store the toner.

29 Claims, 19 Drawing Sheets

(56) References Cited

U.S. PATENT DOCUMENTS

| | | | | |
|---|---|---|---|---|
| 2018/0095406 | A1* | 4/2018 | Sato | G03G 21/1666 |
| 2019/0146405 | A1* | 5/2019 | Itabashi | G03G 21/1609<br>399/111 |

FOREIGN PATENT DOCUMENTS

| | | | |
|---|---|---|---|
| JP | 2017-016149 | A | 1/2017 |
| JP | 2018-136470 | A | 8/2018 |
| WO | 2014/192975 | A1 | 12/2014 |

* cited by examiner

IMAGE-FORMING APPARATUS INCLUDING MOVABLE DRAWER ON WHICH TONER CARTRIDGE IS MOUNTABLE WITHOUT PROCESS CARTRIDGE

CROSS REFERENCE TO RELATED APPLICATION

This application claims priority from Japanese Patent Application No. 2019-232607 filed Dec. 24, 2019. The entire content of the priority application is incorporated herein by reference.

TECHNICAL FIELD

The present disclosure relates to an image-forming apparatus.

BACKGROUND

Conventionally, an image-forming apparatus includes a main casing, a drawer, a process cartridge, and a toner cartridge. The drawer is movable between an inner position and an outer position. The drawer is located inside the main casing when the drawer is at the inner position. The drawer is located outside the main casing when the drawer is at the outer position. The process cartridge includes a photosensitive drum and a developing device. The developing device can supply toner to the photosensitive drum. The process cartridge is attachable to and detachable from the drawer. The toner cartridge stores toner therein. The toner cartridge is attachable to and detachable from the process cartridge (for example, refer to Japanese Patent Application Publication No. 2011-186067).

SUMMARY

In the above described in image-forming apparatus, a user may happen to inadvertently mount the toner cartridge onto the drawer in a state where the process cartridge is removed from the drawer.

In this case, the drawer may be inserted into the main casing with the toner cartridge mistakenly mounted on the drawer, with a result that any one of the toner cartridge, the drawer, and the main casing may be damaged.

In view of the foregoing, it is an object of the disclosure to provide an image-forming apparatus that can restrain damage to at least one of a toner cartridge, a drawer, and a main casing, even when the toner cartridge is erroneously mounted on the drawer in a state the process cartridge is removed from the drawer.

In order to attain the above and other objects, according to one aspect, the disclosure provides an image-forming apparatus including a main casing, a drawer, a process, and a toner cartridge. The drawer is movable in a first direction between an inner position and an outer position relative to the main casing. The drawer is accommodated in the main casing at the inner position, and at least a part of the drawer is located outside the main casing at the outer position. The process cartridge is detachably mountable on the drawer. The process cartridge includes: a photosensitive drum rotatable about a drum axis, the drum axis extending in a second direction crossing the first direction when the process cartridge is mounted on the drawer; and a developing device configured to supply toner to the photosensitive drum. The toner cartridge is configured to store the toner. The toner cartridge is detachably mountable on the drawer.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, an image-forming apparatus 1 according to one embodiment of the present disclosure will be described with reference to the accompanying drawings.

1. Overview of Image-Forming Apparatus 1

First, an overall structure of the image-forming apparatus 1 will be described with reference to FIGS. 1 to 3.

Figure 1:
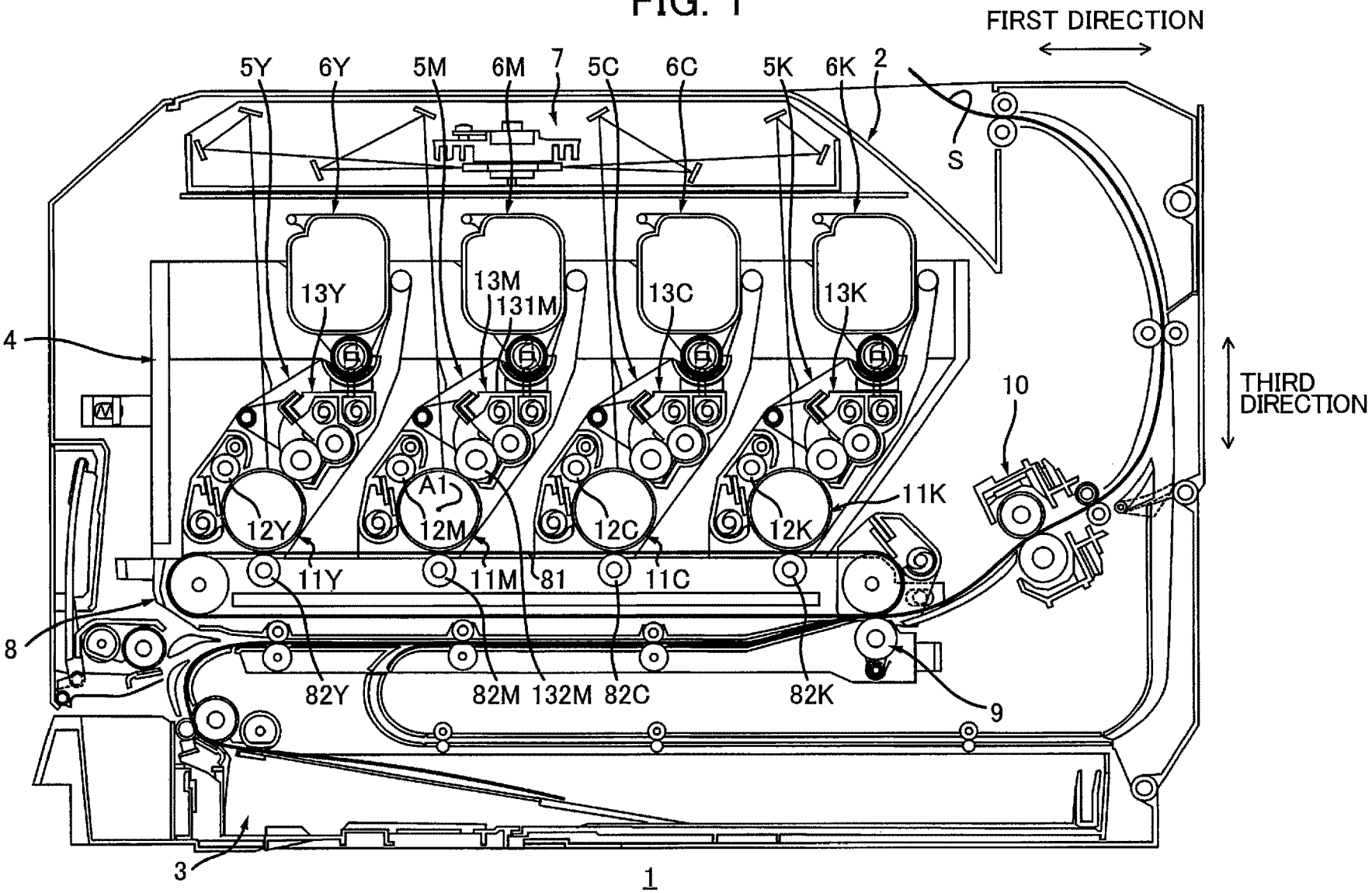
FIG. 1 is a vertical cross-sectional view schematically illustrating an overall configuration of an image-forming apparatus according to one embodiment.

As illustrated in FIG. 1, the image-forming apparatus 1 includes a main casing 2, a sheet cassette 3, a drawer 4, four process cartridges 5Y, 5M, 5C and 5K, four toner cartridges 6Y, 6M, 6C and 6K, an exposure device 7, a belt unit 8, a transfer roller 9, and a fixing device 10.

The main casing 2 is configured to accommodate the sheet cassette 3, the drawer 4, the four process cartridges 5Y, 5M, 5C, and 5K, the four toner cartridges 6Y, 6M, 6C, and 6K, the exposure device 7, the belt unit 8, the transfer roller 9, and the fixing device 10.

Figure 2:
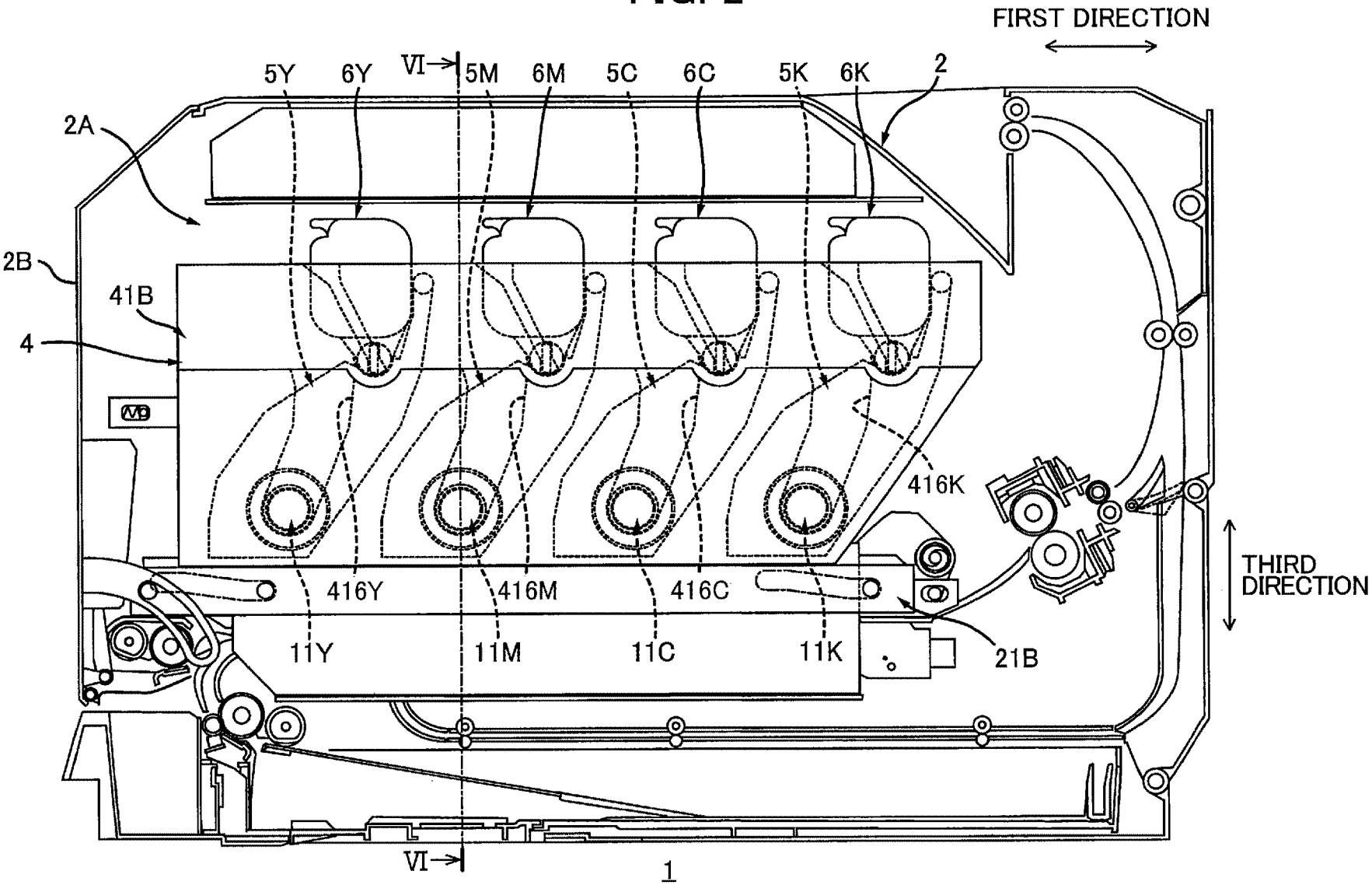
FIG. 2 is an explanatory view illustrating movement of a drawer relative to a main casing of the image-forming apparatus according to one embodiment, wherein the drawer is at an inner position and a cover of the main casing is at a closed position.
Figure 3:
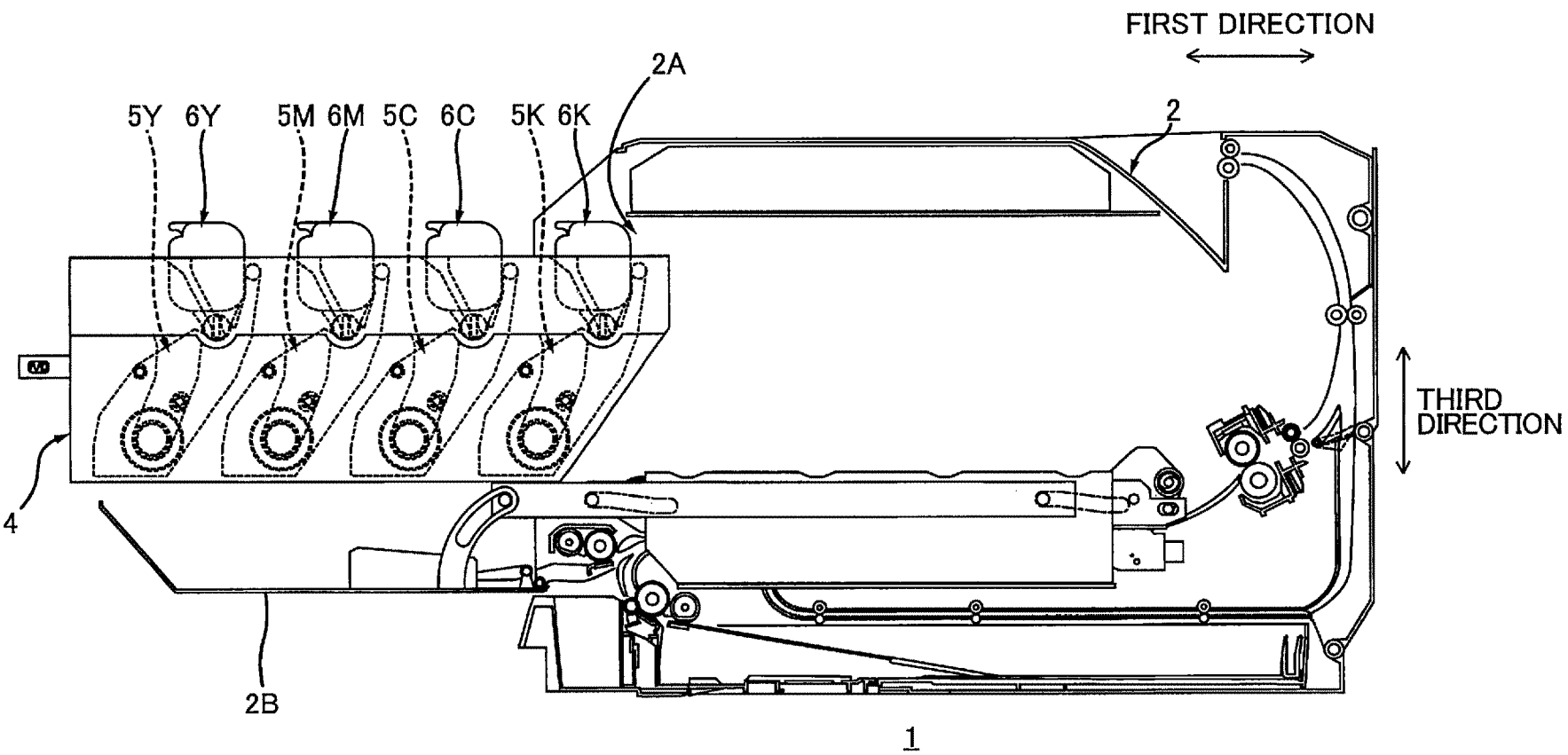
FIG. 3 is an explanatory view illustrating movement of the drawer relative to the main casing in the image-forming apparatus according to one embodiment, wherein the drawer is at an outer position and the cover of the main casing is at an open position.

The drawer 4 is movable relative to the main casing 2, as illustrated in FIGS. 1 to 3. Hereinafter, a direction in which the drawer 4 is movable relative to the main casing 2 will be referred to as a first direction.

As illustrated in FIGS. 2 and 3, the main casing 2 has an opening 2A. The main casing 2 includes a cover 2B.

The opening 2A is formed at one end portion of the main casing 2 in the first direction.

The cover 2B is movable between a closed position (see FIG. 2) and an open position (see FIG. 3). The cover 2B covers the opening 2A when the cover 2B is at the closed position. The cover 2B exposes the opening 2A when the cover 2B is at the open position.

As illustrated in FIG. 1, the sheet cassette 3 is configured to accommodate sheets of paper S. Each sheet S in the sheet cassette 3 is configured to be conveyed toward the transfer roller 9.

As illustrated in FIG. 3, the drawer 4 is movable in the first direction between an inner position (FIG. 2) and an outer position (FIG. 3) via the opening 2A while the cover 2B is at the open position. As illustrated in FIG. 2, the drawer 4 as a whole is located inside the main casing 2 when the drawer 4 is at the inner position. As illustrated in FIG. 3, at least a portion of the drawer 4 is located outside the main casing 2 when the drawer 4 is at the outer position.

The process cartridges 5Y, 5M, 5C, and 5K are respectively attachable to and detachable from the drawer 4. Specifically, each of the process cartridges 5Y, 5M, 5C, and 5K can be mounted on the drawer 4 in a state where the drawer 4 is at the outer position. Each of the process cartridges 5Y, 5M, 5C, and 5K mounted on the drawer 4 can be detached from the drawer 4 while the drawer 4 is at the outer position. When mounted on the drawer 4, the process cartridges 5Y, 5M, 5C, and 5K are arrayed in the first direction.

The process cartridges 5Y, 5M, 5C, and 5K respectively have the same structures as one another. Hence, for simplifying description, description will be made only for the process cartridge 5M as a representative example.

As illustrated in FIG. 1, the process cartridge 5M includes a photosensitive drum 11M, a charging device 12M, and a developing device 13M.

The photosensitive drum 11M extends in a second direction crossing the first direction. The photosensitive drum 11M has a cylindrical shape. The photosensitive drum 11M is rotatable about a first axis A1 extending in the second direction in a state where the process cartridge 5M is mounted on the drawer 4.

The charging device 12M is configured to charge a peripheral surface of the photosensitive drum 11M. In the present embodiment, the charging device 12M is a charging roller, but the charging device 12M may be a scorotron charger.

The developing device 13M is configured to supply toner to the photosensitive drum 11M. Specifically, the developing device 13M includes a developing casing 131M and a developing roller 132M.

The developing casing 131M is configured to store toner that is supplied from the toner cartridge 6M. The developing casing 131M has an opening 133 (see FIG. 10). Toner supplied from the toner cartridge 6M enters the developing casing 131M via the opening 133.

The developing roller 132M can supply the toner in the developing casing 131M to the photosensitive drum 11M. The developing roller 132M is in contact with the photosensitive drum 11M. Incidentally, the developing roller 132M may be configured to be separated from the photosensitive drum 11M.

Each of the toner cartridges 6Y, 6M, 6C, and 6K stores toner of a different color, but the toner cartridges 6Y, 6M, 6C, and 6K have the same structures as one another. Hence, for simplifying description, description will be made mainly for the toner cartridge 6M.

As illustrated in FIG. 3, the toner cartridge 6M is attachable to and detachable to the process cartridge 5M in a state where the process cartridge 5M is mounted on the drawer 4. Specifically, the toner cartridge 6M can be attached to the process cartridge 5M in a state where the process cartridge 5M is mounted on the drawer 4. Likewise, the toner cartridge 6M can be removed from the process cartridge 5M in the state where the process cartridge 5M is mounted on the drawer 4. The toner cartridge 6M can supply toner to the developing device 13M (see FIGS. 1 and 14) while the toner cartridge 6M is attached to the process cartridge 5M.

As illustrated in FIG. 1, the exposure device 7 is configured to expose peripheral surfaces of the respective photosensitive drums 11Y, 11M, 11C, and 11K to light in a state where the drawer 4 is at the inner position with the process cartridges 5Y, 5M, 5C, and 5K mounted on the drawer 4. In the present embodiment, the exposure device 7 is a laser scanning unit.

The belt unit 8 is positioned below the process cartridges 5Y, 5M, 5C, and 5K in the state where the process cartridges 5Y, 5M, 5C, and 5K are mounted on the drawer 4 and the drawer 4 is at the inner position. The belt unit 8 includes an intermediate transfer belt 81 and transfer rollers 82Y, 82M, 82C, and 82K.

The intermediate transfer belt 81 is configured to make contact with each of the photosensitive drums 11Y, 11M, 11C, and 11K when the process cartridges 5Y, 5M, 5C, and 5K are mounted on the drawer 4 and the drawer 4 is at the inner position.

The transfer roller 82Y is configured to transfer toner on the photosensitive drum 11Y onto the intermediate transfer belt 81. The transfer roller 82M is configured to transfer toner on the photosensitive drum 11M onto the intermediate transfer belt 81. The transfer roller 82C is configured to transfer toner on the photosensitive drum 11C onto the intermediate transfer belt 81. The transfer roller 82K is configured to transfer toner on the photosensitive drum 11K onto the intermediate transfer belt 81. In other words, the toner on the photosensitive drum 11Y, the toner on the photosensitive drum 11M, the toner on the photosensitive drum 11C, and the toner on the photosensitive drum 11K are respectively configured to be transferred onto the intermediate transfer belt 81.

The transfer roller 9 is configured to transfer the toner on the intermediate transfer belt 81 onto a sheet S. Specifically, a sheet S conveyed from the sheet cassette 3 toward the transfer roller 9 is conveyed to the fixing device 10 after passing through a position between the transfer roller 9 and the intermediate transfer belt 81. The transfer roller 9 transfers the toner on the intermediate transfer belt 81 onto the sheet S while the sheet S passes the position between the transfer roller 9 and the intermediate transfer belt 81.

The fixing device 10 is configured to apply heat and pressure to the sheet S, so that the toner that has been transferred on the sheet S is thermally fixed to the sheet S. After passing through the fixing device 10, the sheet S is discharged onto an upper surface of the main casing 2.

2. Details of the Drawer 4

Figure 4:
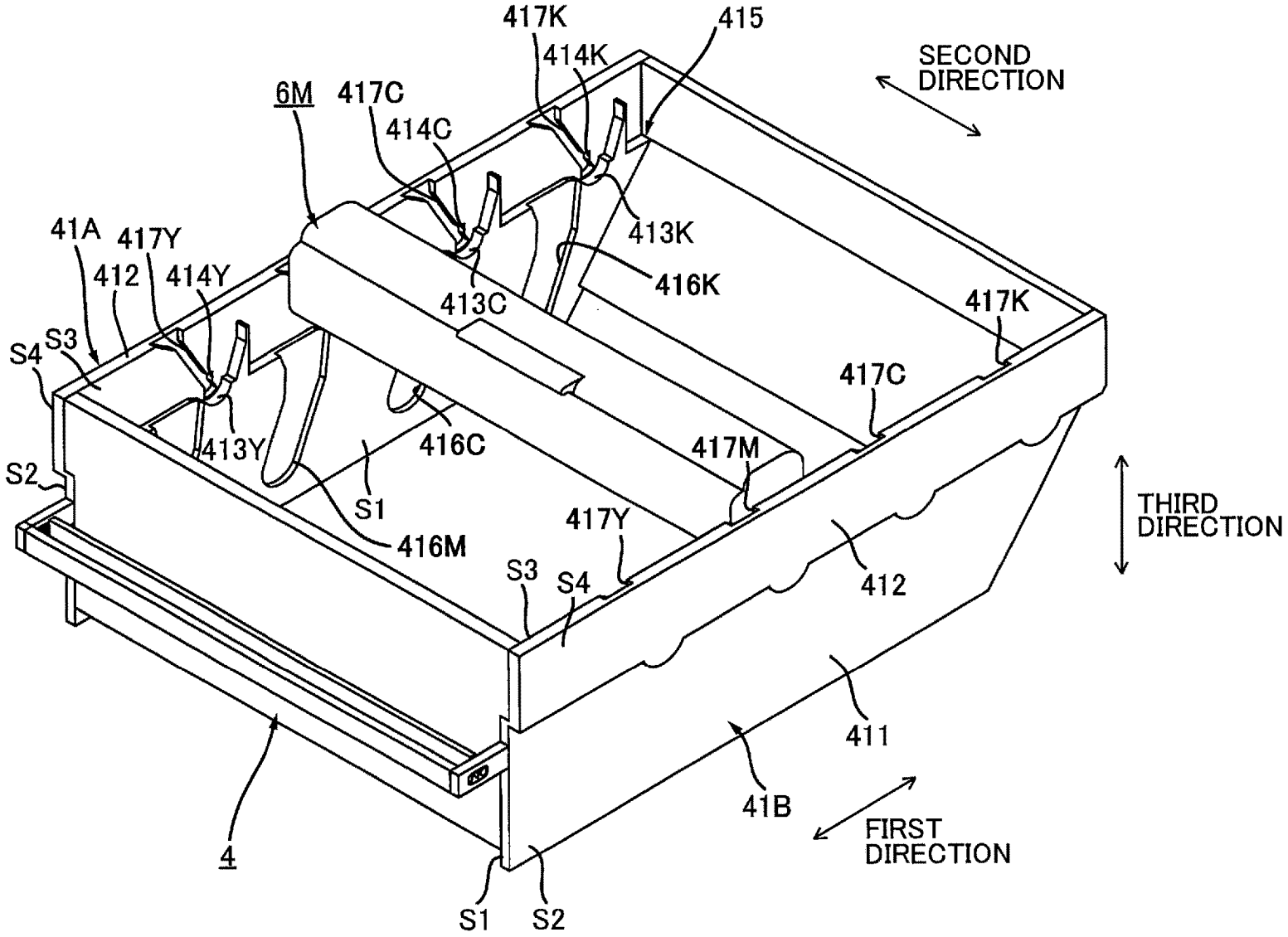
FIG. 4 is a perspective view illustrating the drawer of the image-forming apparatus according to one embodiment, wherein process cartridges are removed from the drawer and on a toner cartridge is mounted on the drawer.

As illustrated in FIG. 4, in the image-forming apparatus 1 according to the present disclosure, the toner cartridge 6M can be mounted on the drawer 4 in a state where the process cartridge 5M is removed from the drawer 4. Further, the toner cartridge 6M mounted on the drawer 4 can be removed from the drawer 4. The drawer 4 is movable between the inner position and the outer position in a state where the toner cartridge 6M is mounted on the drawer 4 but the process cartridge 5M is detached from the drawer 4.

Now, the drawer 4 will be described in detail with reference to FIGS. 5 and 6.

Figure 5:
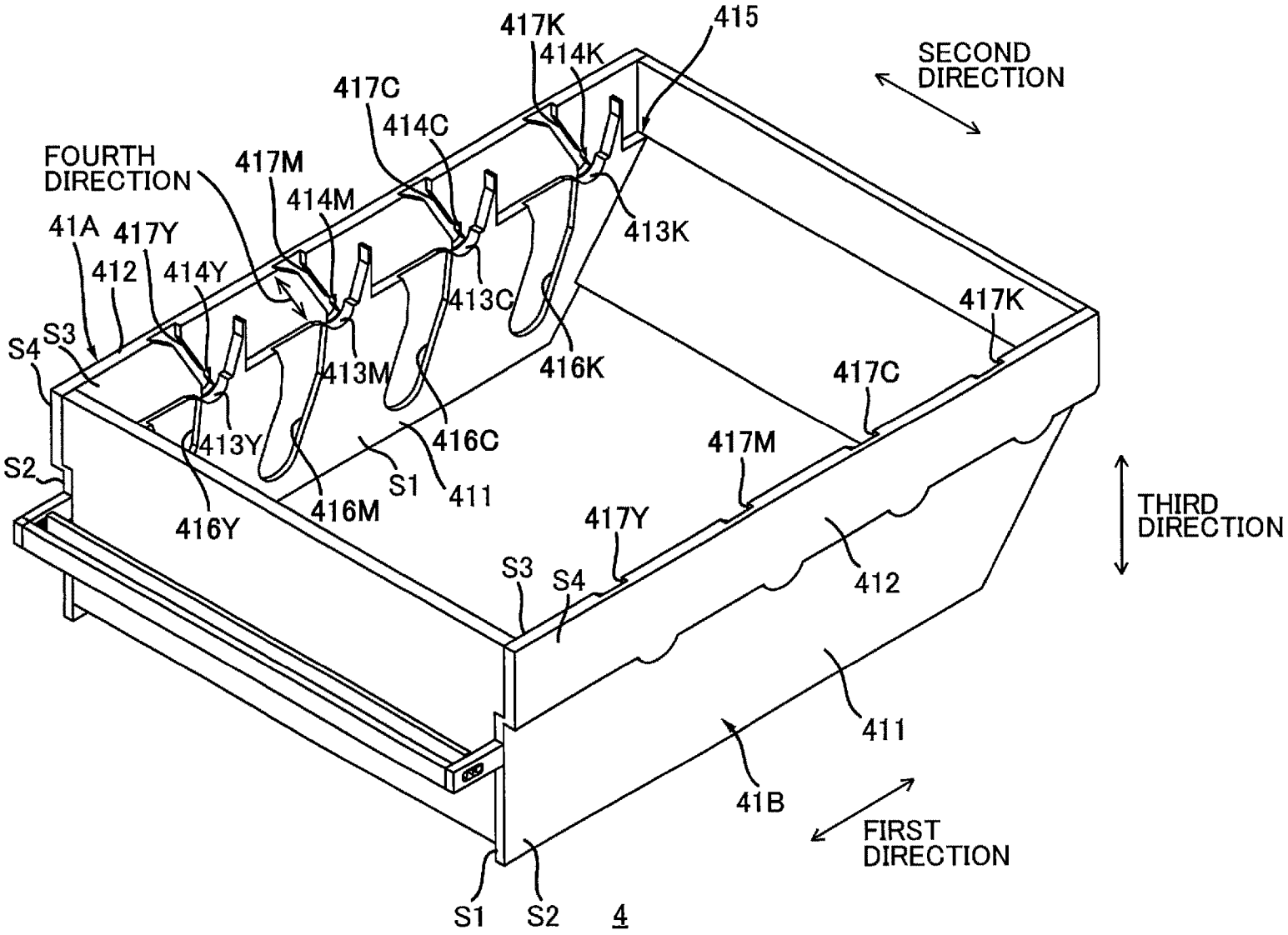
FIG. 5 is a perspective view illustrating the drawer of the image-forming apparatus according to one embodiment.

As illustrated in FIGS. 4 and 5, the drawer 4 has an open end that is open in a third direction crossing both the first direction and the second direction. Preferably, the third direction is orthogonal to both the first direction and the second direction. In the present embodiment, the third direction coincides with an up-down direction (vertical direction).

Referring to FIG. 5, the drawer 4 includes a drawer side plate 41A and a drawer side plate 41B.

The drawer side plate 41A is positioned at one end portion of the drawer 4 in the second direction. The drawer side plate 41A extends in the first direction and the third direction.

As illustrated in FIG. 5, the drawer side plate 41B is positioned at another end portion of the drawer 4 in the second direction. The drawer side plate 41B is spaced away from the drawer side plate 41A in the second direction. The drawer side plate 41B has a structure the same as that of the drawer side plate 41A in a symmetrical manner.

Each of the drawer side plate 41A and drawer side plate 41B includes: a first part 411, a second part 412, and four support portions 413Y, 413M, 413C, and 413K. Hereinafter, the drawer side plate 41A illustrated in FIGS. 4 and 5 will be mainly described in detail.

The first part 411 extends in the first direction and the third direction. The first part 411 has a plate-like shape. The first part 411 has an inner surface S1 and an outer surface S2 in the second direction. The inner surface S1 is closer to the drawer side plate 41B than the outer surface S2 is to the drawer side plate 41B in the second direction. To rephrase, the inner surface S1 is positioned between the outer surface S2 and the drawer side plate 41B in the second direction. The first part 411 is configured to support the respective process cartridges 5Y, 5M, 5C, and 5K when the process cartridges 5Y, 5M, 5C, and 5K are mounted on the drawer 4.

The first part 411 includes four process guides 416Y, 416M, 416C, and 416K.

The process guides 416Y, 416M, 416C, and 416K are formed on the inner surface S1 of the first part 411. The process guides 416Y, 416M, 416C, and 416K are arrayed in the first direction and spaced apart from one another in the first direction. Each of the process guides 416Y, 416M, 416C, and 416K extends generally in the third direction. Each of the process guides 416Y, 416M, 416C, and 416K is a recessed groove.

The process guides 416Y, 416M, 416C, and 416K have the same structures as one another. The process guide 416M in the drawer side plate 41A is configured to guide attachment of the process cartridge 5M to the drawer 4 while supporting one end portion of the photosensitive drum 11M in the second direction. The process guide 416M in the drawer side plate 41A can thus guide and support the process cartridge 5M. In the similar manner, the process guides 416Y, 416C, and 416K in the drawer side plate 41A are configured to guide and support another end portions in the second direction of the respective photosensitive drums 11Y, 11C, and 11K (and, hence, the process cartridges 5Y, 5C and 5K), respectively.

The second part 412 is positioned upward of the first part 411 in the third direction in FIG. 5. That is, the second part 412 is positioned closer to the open end of the drawer 4 than the first part 411 is to the open end of the drawer 4 in the third direction. The second part 412 is connected to the first part 411 in the third direction to form a step 415 therebetween. Specifically, the second part 412 extends in the first direction and the third direction. The second part 412 has an inner surface S3 and an outer surface S4 in the second direction. In the drawer side plate 41A, the inner surface S3 is closer to the drawer side plate 41B than the outer surface S4 is to the drawer side plate 41B in the second direction. To rephrase, the inner surface S3 is positioned between the outer surface S4 and the drawer side plate 41B in the second direction.

Figure 6:
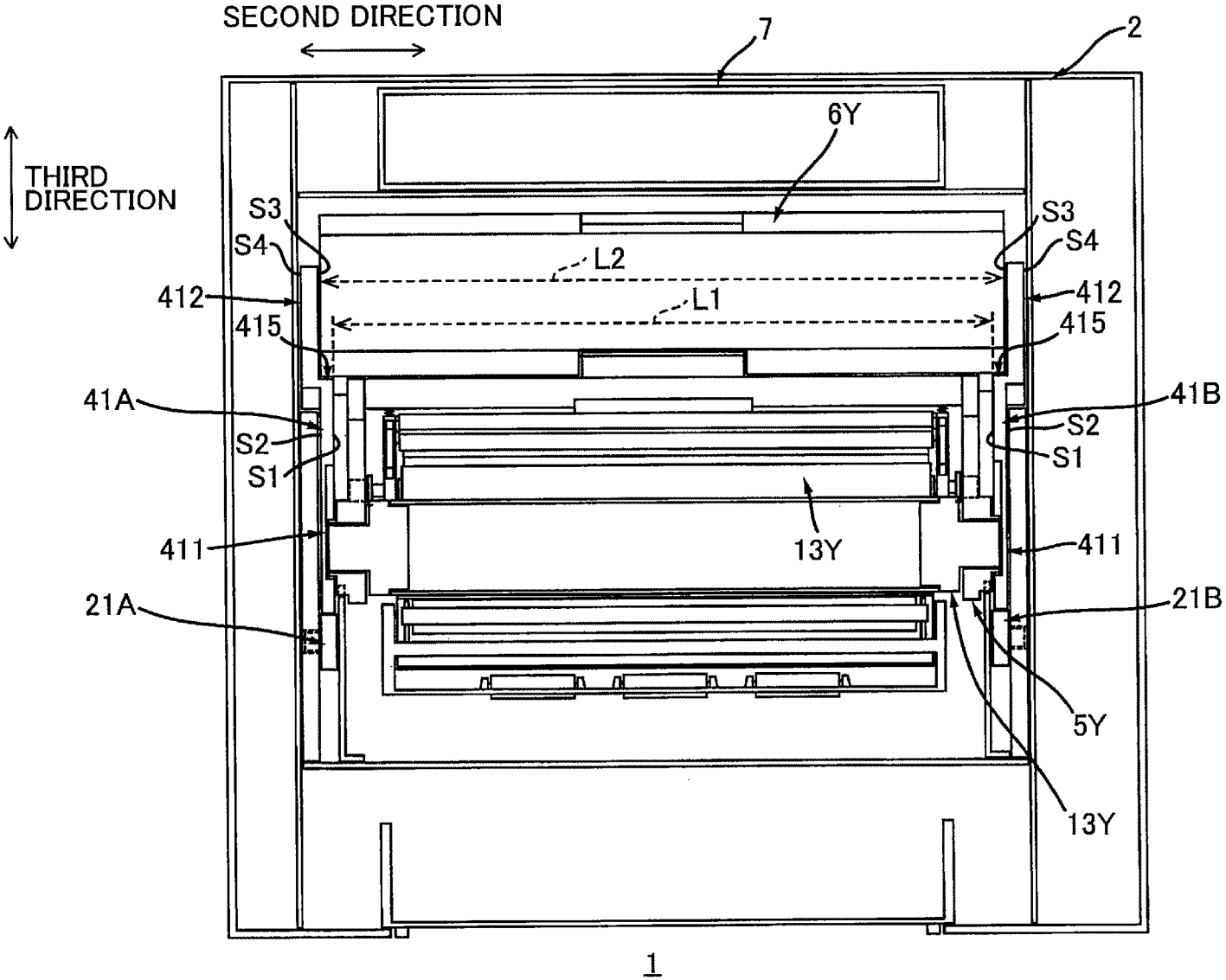
FIG. 6 is a cross-sectional view of the image-forming apparatus according to one embodiment taken along a plane VI-VI in FIG. 2.

As illustrated in FIG. 6, the inner surface S3 of the second part 412 is positioned farther from the drawer side plate 41B than the inner surface S1 of the first part 411 is from the drawer side plate 41B in the second direction. That is, a distance L2 in the second direction defined between the second part 412 of the drawer side plate 41A and the second part 412 of the drawer side plate 41B is greater than a distance L1 in the second direction defined between the first part 411 of the drawer side plate 41A and the first part 411 of the drawer side plate 41B (L2>L1). In a state where the toner cartridges 6Y, 6M, 6C, and 6K are mounted on the drawer 4, the second part 412 of the drawer side plate 41A and the second part 412 of the drawer side plate 41B are configured to support the toner cartridges 6Y, 6M, 6C, and 6K.

As illustrated in FIG. 5, each second part 412 includes: four toner guides 417Y, 417M, 417C, and 417K; and four lock portions 414Y, 414M, 414C, and 414K.

The toner guides 417Y, 417M, 417C, and 417K are formed on the inner surface S3 of the second part 412. The toner guides 417Y, 417M, 417C, and 417K are arrayed in the first direction to be spaced apart from one another. The toner guides 417Y, 417M, 417C, and 417K have the same structures as one another. Hence, description will be made mainly on the toner guide 417M for simplifying description.

The toner guide 417M extends in a fourth direction crossing an extending direction of the process guide 416M. Specifically, the toner guide 417M extends in the fourth direction crossing the third direction. The fourth direction also crosses the first direction and is orthogonal to the second direction. Sine the toner guide 417M extends to cross the extending direction of the process guide 416M, the process cartridge 5M cannot be detached from the drawer 4 in a state where the process cartridge 5M is mounted on the drawer 4 and the toner cartridge 6M is attached to the process cartridge 5M (see FIG. 3). On the other hand, the process cartridge 5M mounted on the drawer 4 is allowed to be detached from the drawer 4 in a state where the process cartridge 5M is mounted on the drawer 4 while the toner cartridge 6M is detached from the process cartridge 5M (see FIG. 8). The toner guide 417M is a recessed groove.

The toner guide 417M in the drawer side plate 41A is configured to guide a protrusion 62A of the toner cartridge 6M (see FIG. 11) in a state where the toner cartridge 6M is attached to the process cartridge 5M mounted on the drawer 4; or in a state where the toner cartridge 6M is mounted on the drawer 4 from which the process cartridge 5M has been removed.

Likewise, the toner guide 417M in the drawer side plate 41B is configured to guide a protrusion 62B of the toner cartridge 6M (see FIG. 11) in the state where the toner cartridge 6M is attached to the process cartridge 5M mounted on the drawer 4; or in the state where the toner cartridge 6M is mounted on the drawer 4 from which the process cartridge 5M has been removed.

In this way, the toner guides 417M guide attachment of the toner cartridge 6M. The protrusions 62A and 62B of the toner cartridge 6M will be described later.

The lock portions 414Y, 414M, 414C, and 414K have the same structure as one another, and, hence, the lock portion 414M will be mainly described hereinafter. The lock portion 414M is formed on the inner surface S3 of the second part 412. The lock portion 414M is positioned midway on the toner guide 417M in the fourth direction. The lock portion 414M extends in the third direction from the midway point of the toner guide 417M. The lock portion 414M is a recessed groove. The lock portion 414M is continuous with the toner guide 417M.

The support portions 413Y, 413M, 413C, and 413K in the drawer side plate 41A are positioned at one end portion of the first part 411 of the drawer side plate 41A in the third direction (i.e., at an upper end portion of the first part 411 in FIG. 5). That is, the support portions 413Y, 413M, 413C, and 413K are formed on the step 415 of the drawer side plate 41A. The support portions 413Y, 413M, 413C, and 413K are arrayed in the first direction to be spaced apart from one another. Each of the support portions 413Y, 413M, 413C, and 413K is recessed in a direction away from the second part 412 in the third direction (downward in FIG. 5). Each support portion 413Y, 413M, 413C, 413K has an arcuate shape in a side view.

As illustrated in FIG. 4, the support portion 413M of the drawer side plate 41A supports one end portion of the toner cartridge 6M in the second direction in a state where the toner cartridge 6M is mounted in the drawer 4 with the process cartridge 5M detached from the drawer 4. Specifically, the support portion 413M is configured to support one end portion in the second direction of a second container 612 of the process cartridge 5M (see FIG. 11) in the state where the toner cartridge 6M is mounted on the drawer 4 while the process cartridge 5M is removed from the drawer 4.

The support portions 413Y, 413M, 413C, and 413K are also formed in the drawer side plate 41B.

The support portion 413M of the drawer side plate 41B is positioned at the one end portion in the third direction of the first part 411 of the drawer side plate 41B (i.e., at an upper end portion of the first part 411 in FIG. 4). That is, the support portions 413Y, 413M, 413C, and 413K are formed on the step 415 of the drawer side plate 41B. As illustrated in FIG. 4, the support portion 413M of the drawer side plate 41B supports another end portion of the toner cartridge 6M in the second direction in the state where the toner cartridge 6M is mounted in the drawer 4 with the process cartridge 5M removed from the drawer 4. Specifically, the support portion 413M of the drawer side plate 41B supports another end portion of the second container 612 in the second direction in the state where the toner cartridge 6M is mounted in the drawer 4 with the process cartridge 5M detached from the drawer 4.

3. Details of the Main Casing 2

Next, the main casing 2 will be described in detail with reference to FIG. 6.

The main casing 2 includes a drawer guide 21A and a drawer guide 21B.

In a state where the drawer 4 is at the inner position, the drawer guide 21A is positioned below the drawer side plate 41A. The drawer guide 21A is configured to guide the drawer side plate 41A while the drawer 4 moves between the inner position and the outer position. Specifically, the drawer guide 21A has a flat plate-like shape and extends in the first direction. The drawer guide 21A is configured to make contact with a lower end portion of the drawer side plate 41A. The drawer side plate 41A is configured to slide on the drawer guide 21A in accordance with the movement of the drawer 4 between the inner position and the outer position.

The drawer guide 21B is spaced apart from the drawer guide 21A in the second direction. The drawer guide 21B is positioned below the drawer side plate 41B when the drawer 4 is at the inner position.

The drawer guide 21B has the same structure as the drawer guide 21A. The drawer guide 21B is configured to make contact with a lower end portion of the drawer side plate 41B. The drawer side plate 41B is configured to slide on the drawer guide 21B in accordance with the movement of the drawer 4 between the inner position and the outer position.

4. Details of the Process Cartridge 5M

Now, the process cartridge 5M will be described in detail with reference to FIGS. 7 to 10.

In the following description, the "first direction," "second direction," "third direction" and "fourth direction" with respect to the process cartridge 5M will be referred to based on an assumption that the process cartridge 5M is mounted on the drawer 4. Hence, the "first direction," "second direction," "third direction" and "fourth direction" with respect to the process cartridge 5M are coincident with the "first direction," "second direction," "third direction" and "fourth direction" with respect to the image-forming apparatus 1 and drawer 4.

Figure 7:
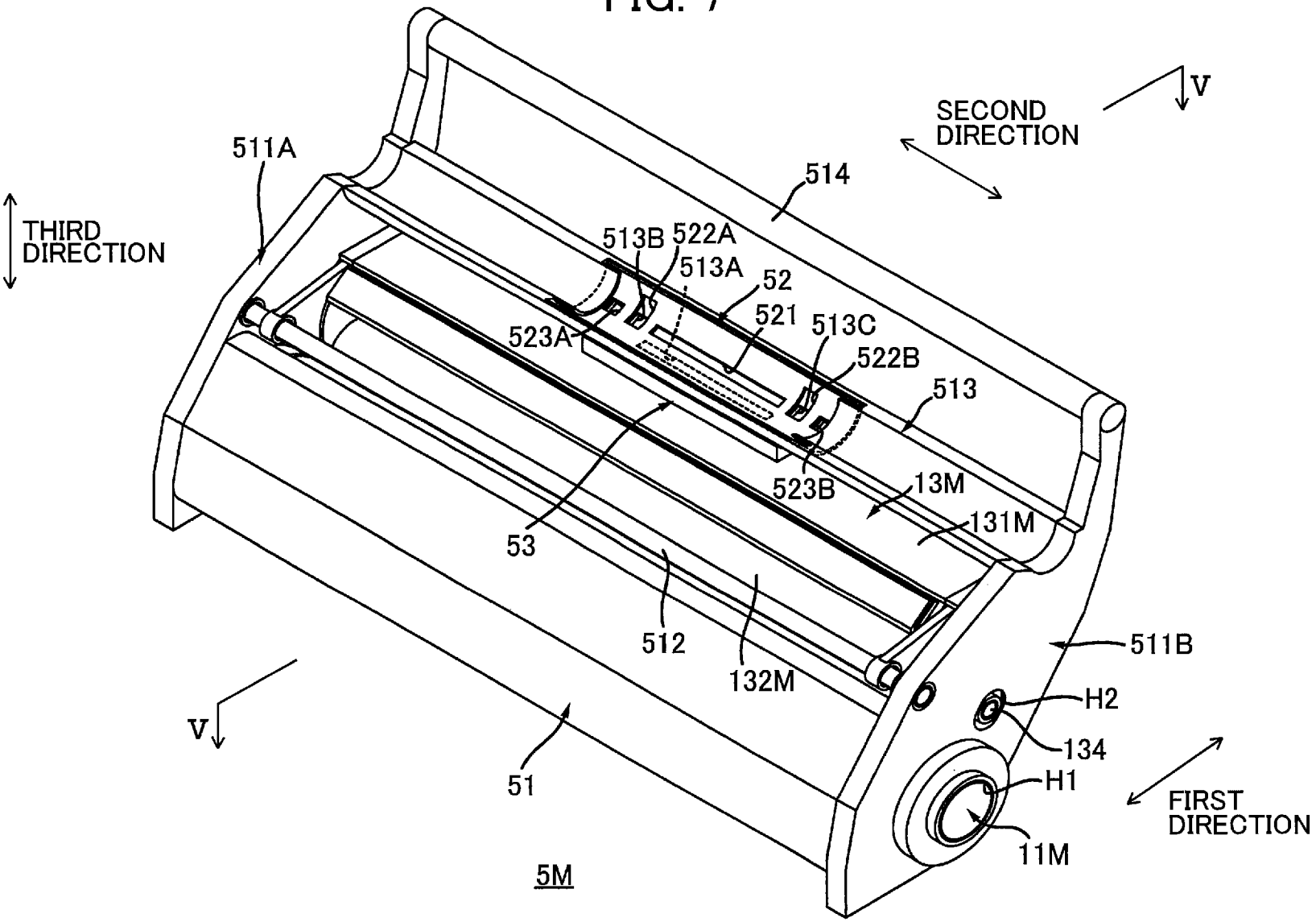
FIG. 7 is a perspective view of the process cartridge according to the embodiment, wherein a shutter of the process cartridge is at a closed position.

As illustrated in FIG. 7, the process cartridge 5M includes a process frame 51, a shutter 52, and a sealing member 53, in addition to the photosensitive drum 11M, the charging device 12M, and the developing device 13M described above.

The process frame 51 extends in the second direction. The process frame 51 supports the photosensitive drum 11M, the charging device 12M, and the developing device 13M. The process frame 51 includes a drum side plate 511A, a drum side plate 511B, a shaft 512, a receiving part 513, and a grip 514. In other words, the process cartridge 5M includes the receiving part 513 and the grip 514.

The drum side plate 511A is positioned at one end portion of the process frame 51 in the second direction. The drum side plate 511A extends in the third direction. The drum side plate 511A supports: one end portion in the second direction of the photosensitive drum 11M; and one end portion in the second direction of the developing device 13M.

The drum side plate 511B is positioned at another end portion of the process frame 51 in the second direction. The drum side plate 511B is spaced apart from the drum side plate 511A in the second direction. The drum side plate 511B supports: another end portion in the second direction of the photosensitive drum 11M; and another end portion in the second direction of the developing device 13M.

The drum side plate 511A and drum side plate 511B have the same structure as each other. Hereinafter, description will be made mainly on the drum side plate 511B illustrated in FIGS. 7 and 9.

Specifically, the drum side plate 511B has a hole H1 and a hole H2.

The hole H1 is formed in another end portion of the drum side plate 511B in the third direction (i.e., a lower end portion in FIG. 7). The hole H1 is spaced apart from the receiving part 513 in the third direction. The hole H1 has a circular shape. The other end portion in the second direction of the photosensitive drum 11M is rotatably fitted in the hole H1. The drum side plate 511B thus rotatably supports the other end portion of the photosensitive drum 11M in the second direction.

The hole H2 is positioned between the hole H1 and the receiving part 513 in the third direction. The hole H2 has an elongated shape, and a protrusion 134 of the developing device 13M is received in the hole H2. The protrusion 134 is positioned at another end portion of the developing casing 131M in the second direction. The protrusion 134 has a columnar shape and extends in the second direction. Incidentally, the hole H2 may receive a shaft of the developing roller 132M, instead of the protrusion 134. With the hole H2 receiving the protrusion 134, the drum side plate 511B supports the other end portion of the developing device 13M in the second direction. With the protrusion 134 fitted in the elongated hole H2, the protrusion 134 is movable relative to the drum side plate 511B in an extending direction of the hole H2. In other words, with the protrusion 134 fitted in the hole H2, the developing device 13M is movable relative to the drum side plate 511B in the extending direction of the hole H2.

Likewise, the one end portion in the second direction of the photosensitive drum 11M is rotatably fitted in the hole H1 of the drum side plate 511A. With the hole H2 of the drum side plate 511A receiving the protrusion 134 provided at one end portion of the developing casing 131M in the second direction, the developing device 13M (including the protrusion 134) is movable relative to the drum side plate 511A in the extending direction of the hole H2.

The shaft 512 extends in the second direction. The shaft 512 has a columnar shape. One end portion of the shaft 512 in the second direction is supported by the drum side plate 511A. Another end portion of the shaft 512 in the second direction is supported by the drum side plate 511B. The developing device 13M is connected to the shaft 512 so that the developing device 13M is pivotable about an axis of the shaft 512.

Figure 10:
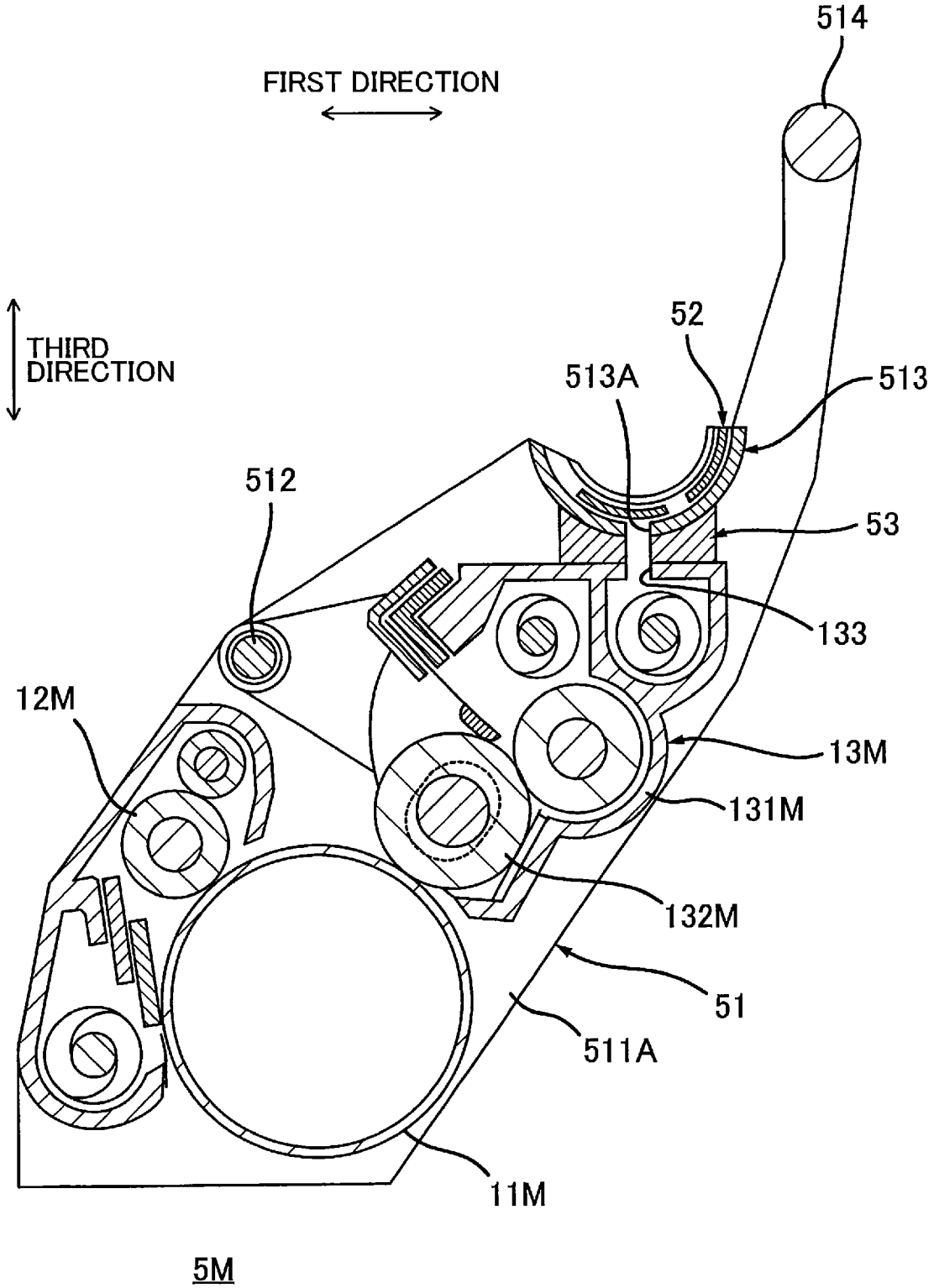
FIG. 10 is a cross-sectional view of the process cartridge according to the embodiment taken along a plane V-V in FIG. 7.

As illustrated in FIGS. 7 and 10, the receiving part 513 extends in the second direction. The receiving part 513 has a semi-cylindrical shape that is recessed toward the developing device 13M (the photosensitive drum 11M) in the third direction (downward in FIG. 7). The receiving part 513 is positioned between the drum side plate 511A and the drum side plate 511B in the second direction.

Figure 8:
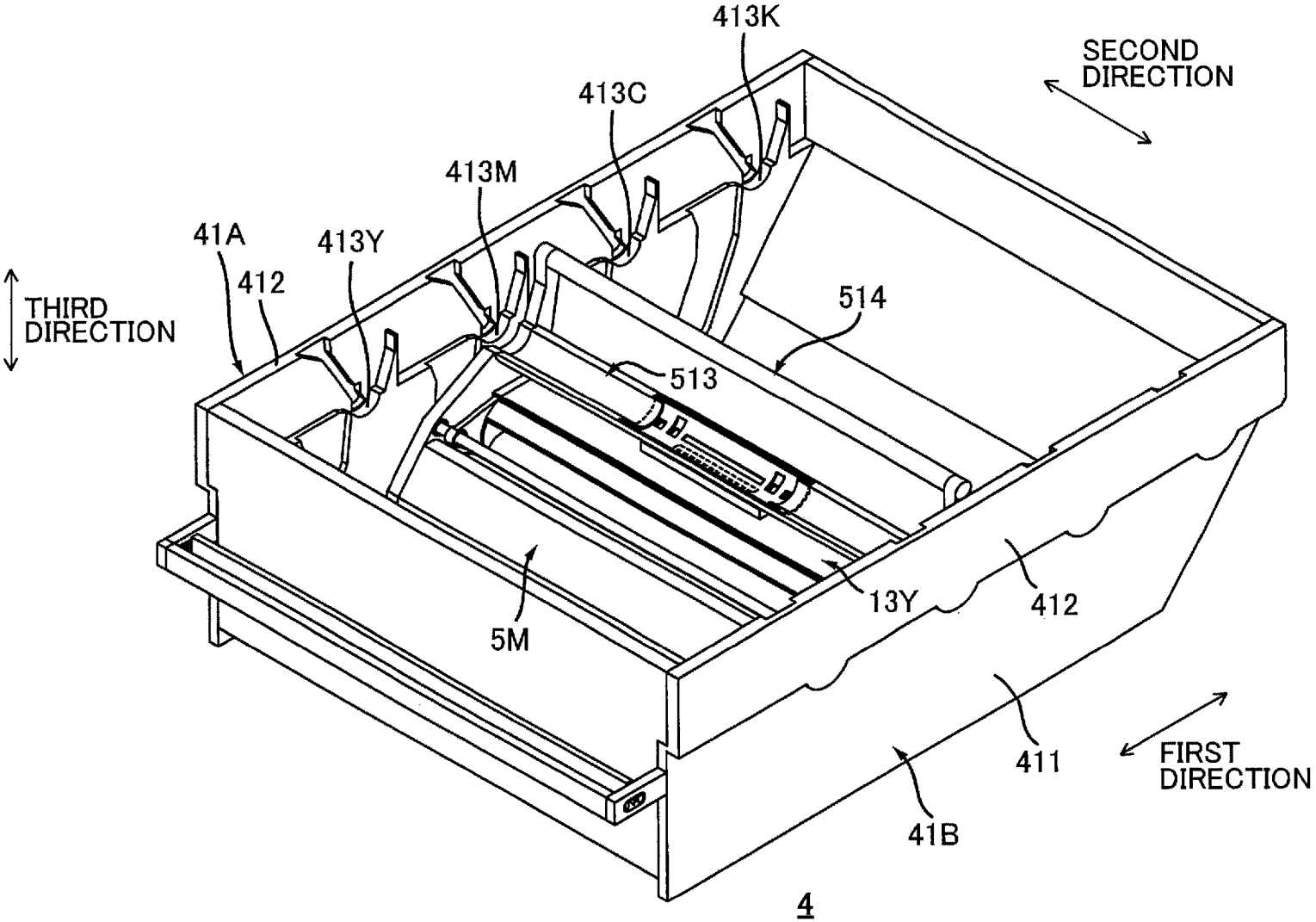
FIG. 8 is a perspective view of the drawer according to the embodiment, wherein the process cartridge is mounted on the drawer and the toner cartridge is detached from the drawer.

As illustrated in FIG. 8, in a state where the process cartridge 5M is mounted on the drawer 4, the receiving part 513 is positioned above the developing device 13M. That is, the receiving part 513 is positioned closer to the open end of the drawer 4 than the developing device 13M is to the open end of the drawer 4 in the third direction. Further, in the state where the process cartridge 5M is mounted on the drawer 4, the receiving part 513 is positioned between the support portion 413M of the drawer side plate 41A and the support portion 413M of the drawer side plate 41B in the second direction. The support portion 413M of the drawer side plate 41A, the support portion 413M of the drawer side plate 41B, and the receiving part 513 are arranged in line in the second direction when the process cartridge 5M is mounted on the drawer 4. The receiving part 513 is configured to receive the second container 612 of the toner cartridge 6M (see FIG. 11) in the state where the toner cartridge 6M is attached to the process cartridge 5M. The second container 612 of the toner cartridge 6M will be described later.

In the state where the process cartridge 5M is mounted on the drawer 4, the receiving part 513 is positioned slightly higher (further toward the one side in the third direction) than the respective support portions 413M of the drawer side plate 41A and the drawer side plate 41B in the third direction. With this configuration, in the state where the toner cartridge 6M is attached to the process cartridge 5M mounted on the drawer 4, the receiving part 513 is in contact with the second container 612, whereas the support portion 413M of the drawer side plate 41A and the support portion 413M of the drawer side plate 41B are respectively slightly spaced apart from the second container 612 in the third direction. Incidentally, the receiving part 513, the support portion 413M of the drawer side plate 41A, and the support portion 413M of the drawer side plate 41B may all be in contact with the second container 612 when the toner cartridge 6M is attached to the process cartridge 5M mounted on the drawer 4.

The receiving part 513 has a toner receiving opening 513A and two holes 513B and 513C. That is, the process cartridge 5M has the hole 513B.

The toner receiving opening 513A is positioned in a center portion of the receiving part 513 in the second direction. The toner receiving opening 513A is in communication with the opening 133 of the developing casing 131M (see FIG. 10). The toner receiving opening 513A is configured to receive toner discharged through a toner discharge opening 614 of the toner cartridge 6M (see FIG. 14) when the toner cartridge 6M is attached to the process cartridge 5M. The toner discharge opening 614 will be described later.

The hole 513B is positioned between the toner receiving opening 513A and the drum side plate 511A in the second direction. The hole 513B is spaced apart from the toner receiving opening 513A in the second direction.

The hole 513C is positioned between the toner receiving opening 513A and the drum side plate 511B in the second direction. The hole 513C is positioned opposite the hole 513B with respect to the toner receiving opening 513A in the second direction. The hole 513C is spaced apart from the toner receiving opening 513A in the second direction.

The grip 514 is positioned at one end portion of the process cartridge 5M in the third direction. Specifically, the grip 514 is connected to one end portion in the third direction of the drum side plate 511A and to one end portion in the third direction of the drum side plate 511B. The grip 514 is positioned closer to the open end of the drawer 4 than each support portion 413M is to the open end of the drawer 4 in the third direction in the state where the process cartridge 5M is mounted on the drawer 4. The grip 514 is positioned opposite the photosensitive drum 11M with respect to the receiving part 513 in the third direction. The grip 514 is spaced apart from the receiving part 513 in the third direction. The grip 514 extends in the second direction and has a columnar shape. A user can hold the grip 514 for handling of the process cartridge 5M.

As illustrated in FIG. 8, in the state where the process cartridge 5M is mounted on the drawer 4, the grip 514 is positioned further upward, or toward the one side in the third direction (i.e., closer to the open end of the drawer 4), than the respective support portions 413M of the drawer side plates 41A and 41B in the third direction. With this configuration, the user can easily hold the grip 514 from the one side in the third direction (from above in FIG. 8) when the process cartridge 5M is mounted in the drawer 4. The user can easily remove, from the drawer 4, the process cartridge 5M mounted in the drawer 4.

Figure 9:
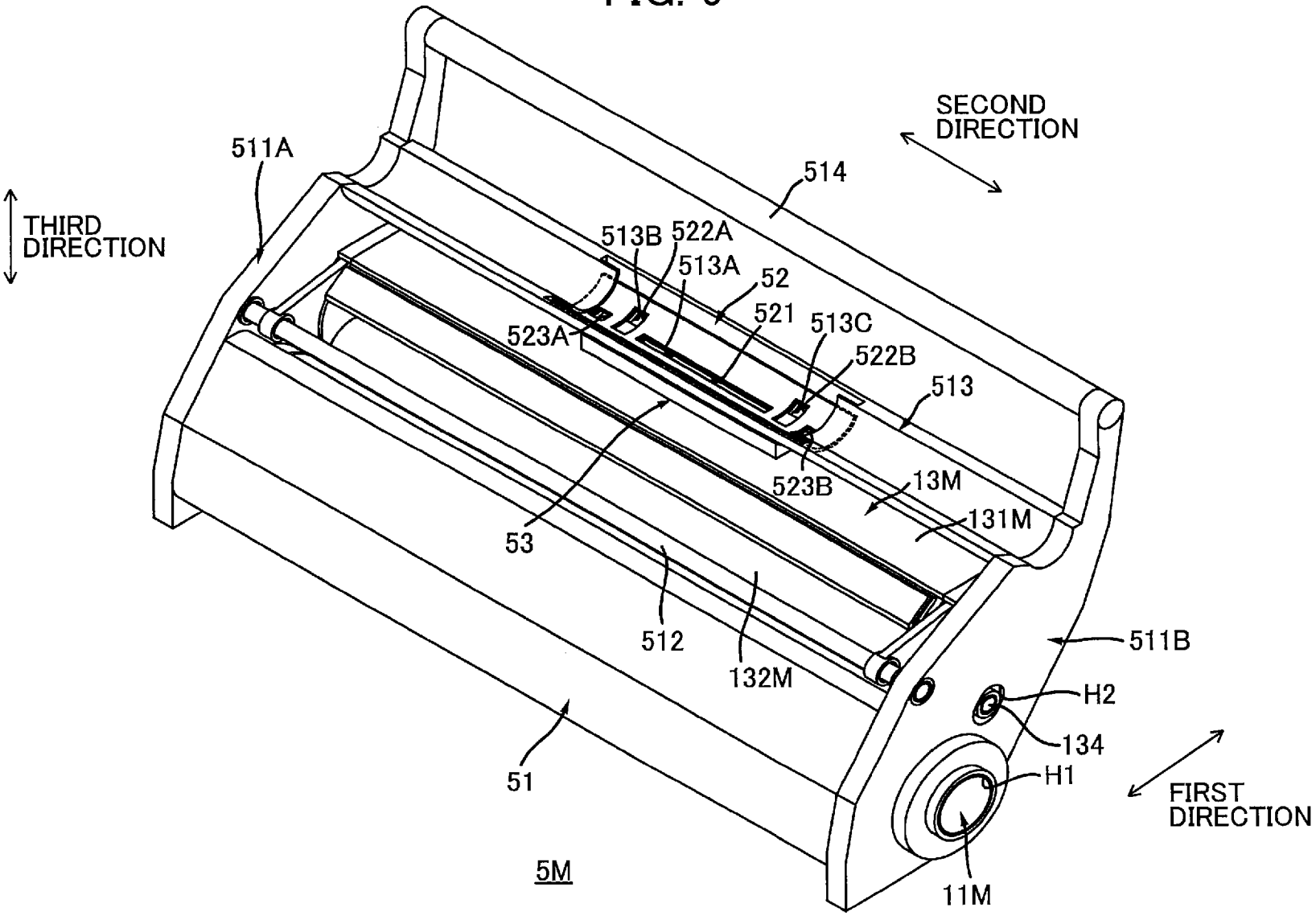
FIG. 9 is a perspective view of the process cartridge according to the embodiment, wherein the shutter of the process cartridge is at an open position.

As illustrated in FIGS. 7 and 9, the shutter 52 is movably attached to the receiving part 513. The shutter 52 is configured to cover and uncover the toner receiving opening 513A. The shutter 52 is movable between a closed position (FIG. 7) and an open position (FIG. 9). The shutter 52 covers the toner receiving opening 513A when the shutter 52 is at the closed position. The toner receiving opening 513A is open when the shutter 52 is at the open position. The shutter 52 has a through-hole 521, two through-holes 522A and 522B, and two through-holes 523A and 523B.

The through-hole 521 extends in the second direction. As illustrated in FIG. 9, the through-hole 521 is at least partially in communication with the toner receiving opening 513A when the shutter 52 is at the open position. Thus, the toner receiving opening 513A is exposed when the shutter 52 is at the open position. On the other hand, as illustrated in FIG. 7, the through-hole 521 is offset from the toner receiving opening 513A when the shutter 52 is at the closed position.

As illustrated in FIGS. 7 and 9, the through-hole 522A is located between the through-hole 521 and the drum side plate 511A in the second direction. The through-hole 522A is spaced apart from the through-hole 521 in the second direction. The through-hole 522A extends in a direction in which the shutter 52 is movable. The through-hole 522A is thus in communication with the hole 513B, regardless of when the shutter 52 is at the closed position or at the open position.

The through-hole 522B is positioned between the through-hole 521 and the drum side plate 511B in the second direction. The through-hole 522B is positioned opposite the through-hole 522A with respect to the through-hole 521 in the second direction. The through-hole 522B is spaced apart from the through-hole 521 in the second direction. The through-hole 522B extends in the direction in which the shutter 52 is movable. The through-hole 522B is in communication with the hole 513C, regardless of when the shutter 52 is at the closed position or at the open position.

The through-hole 523A is positioned between the through-hole 522A and the drum side plate 511A in the second direction. The through-hole 523A is positioned opposite the through-hole 521 with respect to the through-hole 522A in the second direction.

The through-hole 523B is positioned between the through-hole 522B and the drum side plate 511B in the second direction. The through-hole 523B is opposite the through-hole 521 with respect to the through-hole 522B in the second direction.

As illustrated in FIGS. 7 and 10, the sealing member 53 is provided between the receiving part 513 and the developing casing 131M in the third direction. The sealing member 53 seals a gap between the receiving part 513 and the developing casing 131M. The sealing member 53 surrounds the toner receiving opening 513A of the receiving part 513 and the opening 133 of the developing casing 131M. With this configuration, the sealing member 53 can prevent toner flowing into the opening 133 from the toner receiving opening 513A from leaking out of a region between the receiving part 513 and the developing casing 131M. The sealing member 53 is made of sponge, for example.

5. Details of the Toner Cartridge 6M

Now, the toner cartridge 6M will be described in detail with reference to FIGS. 11 to 19.

In the following description, the "first direction," "second direction," and "third direction" with respect to the toner cartridge 6M will be referred to based on an assumption that: the process cartridge 5M is mounted on the drawer 4 and the toner cartridge 6M is attached to the process cartridge 5M, or an assumption that the toner cartridge 6M is mounted on the drawer 4 in the state where the process cartridge 5M is removed from the drawer 4. Hence, the "first direction," "second direction," and "third direction" with respect to the toner cartridge 6M are coincident with the "first direction," "second direction," and "third direction" with respect to the image-forming apparatus 1 and drawer 4.

Figure 11:
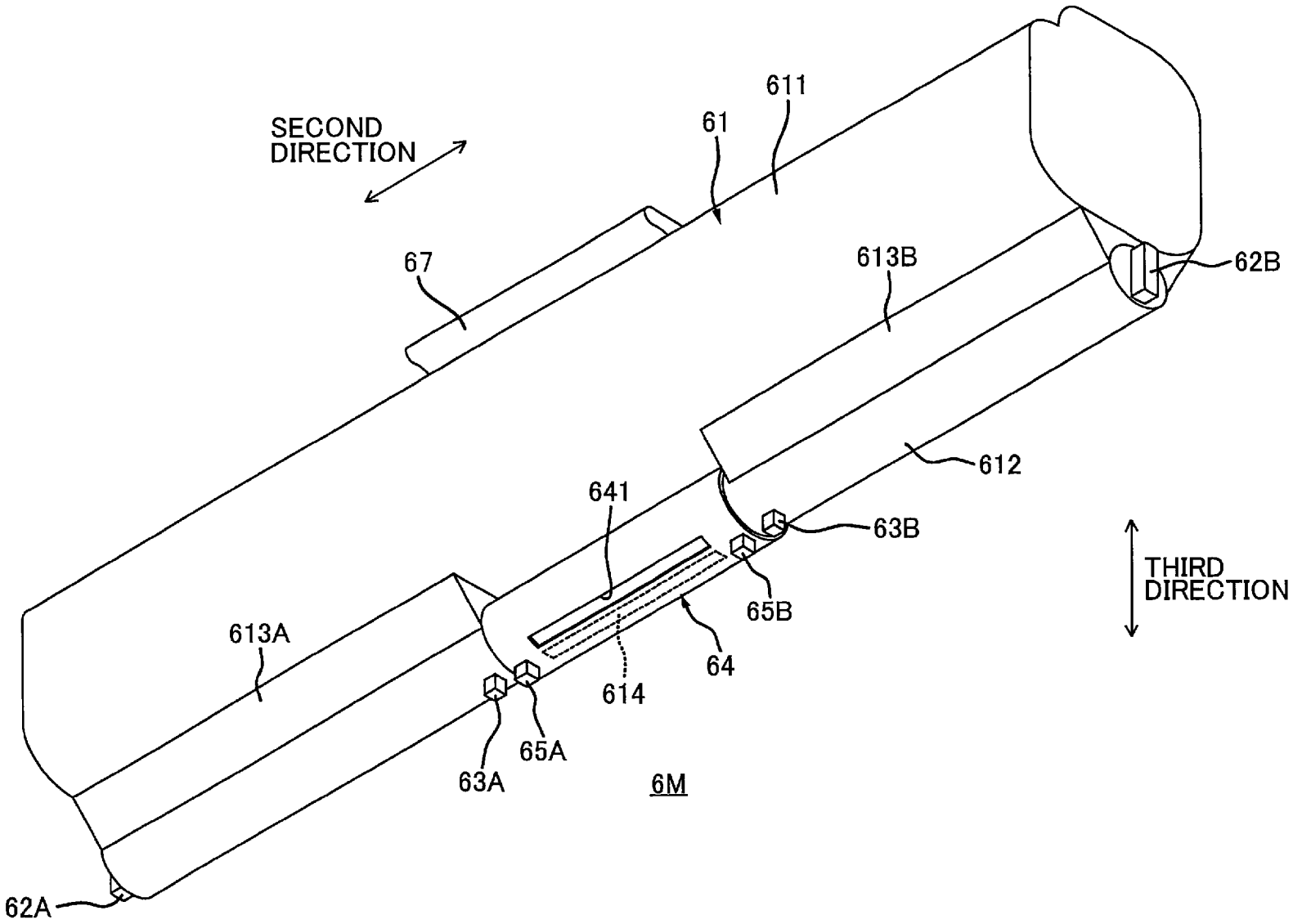
FIG. 11 is a perspective view of the toner cartridge according to the embodiment, wherein a shutter of the toner cartridge is at a closed position.
Figure 12:
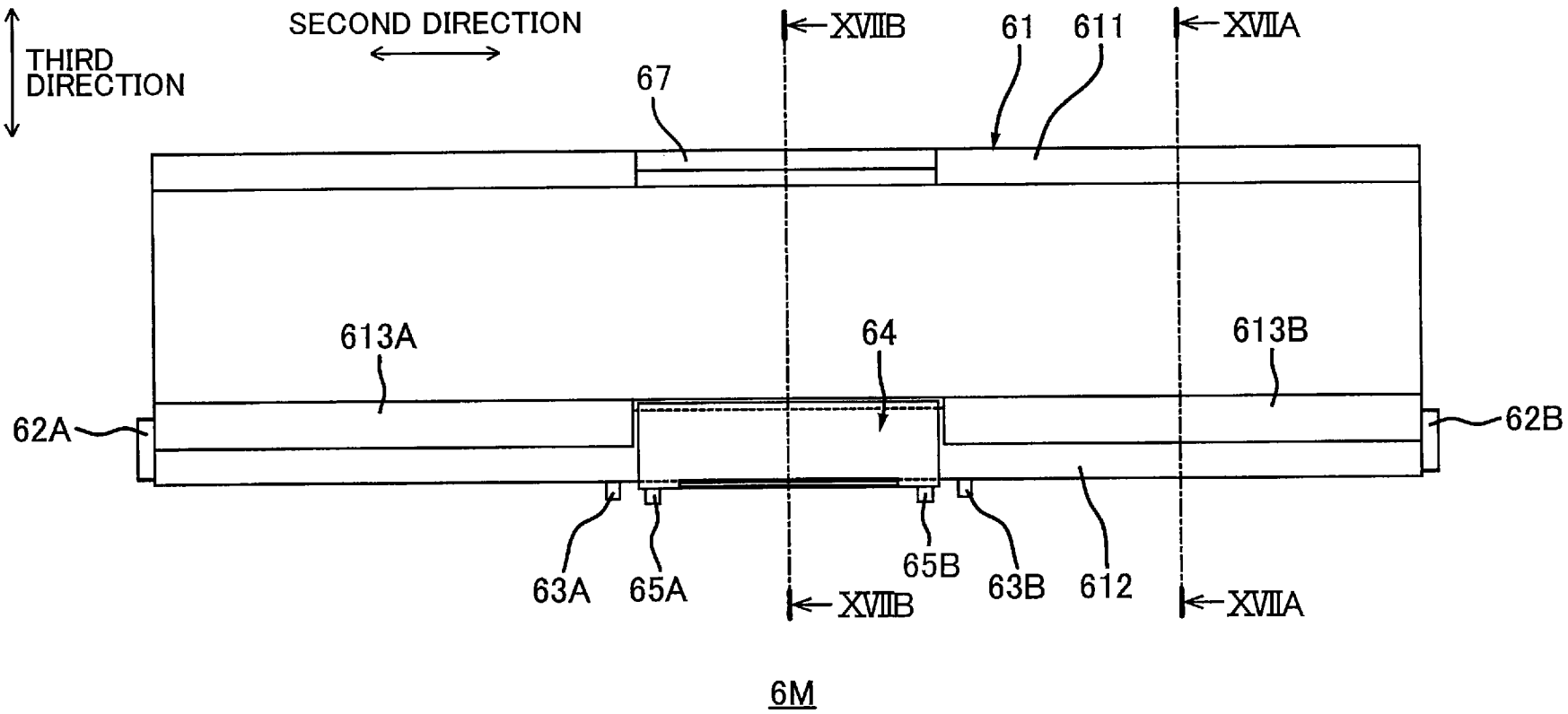
FIG. 12 is a plan view of the toner cartridge according to the embodiment.

As illustrated in FIGS. 11 and 12, the toner cartridge 6M extends in the second direction. The toner cartridge 6M includes a toner casing 61, two protrusions 62A and 62B, two projections 63A and 63B, a shutter 64, two projections 65A and 65B, and a toner conveying member 66 (see FIG. 19).

The toner casing 61 extends in the second direction.

Figure 13:
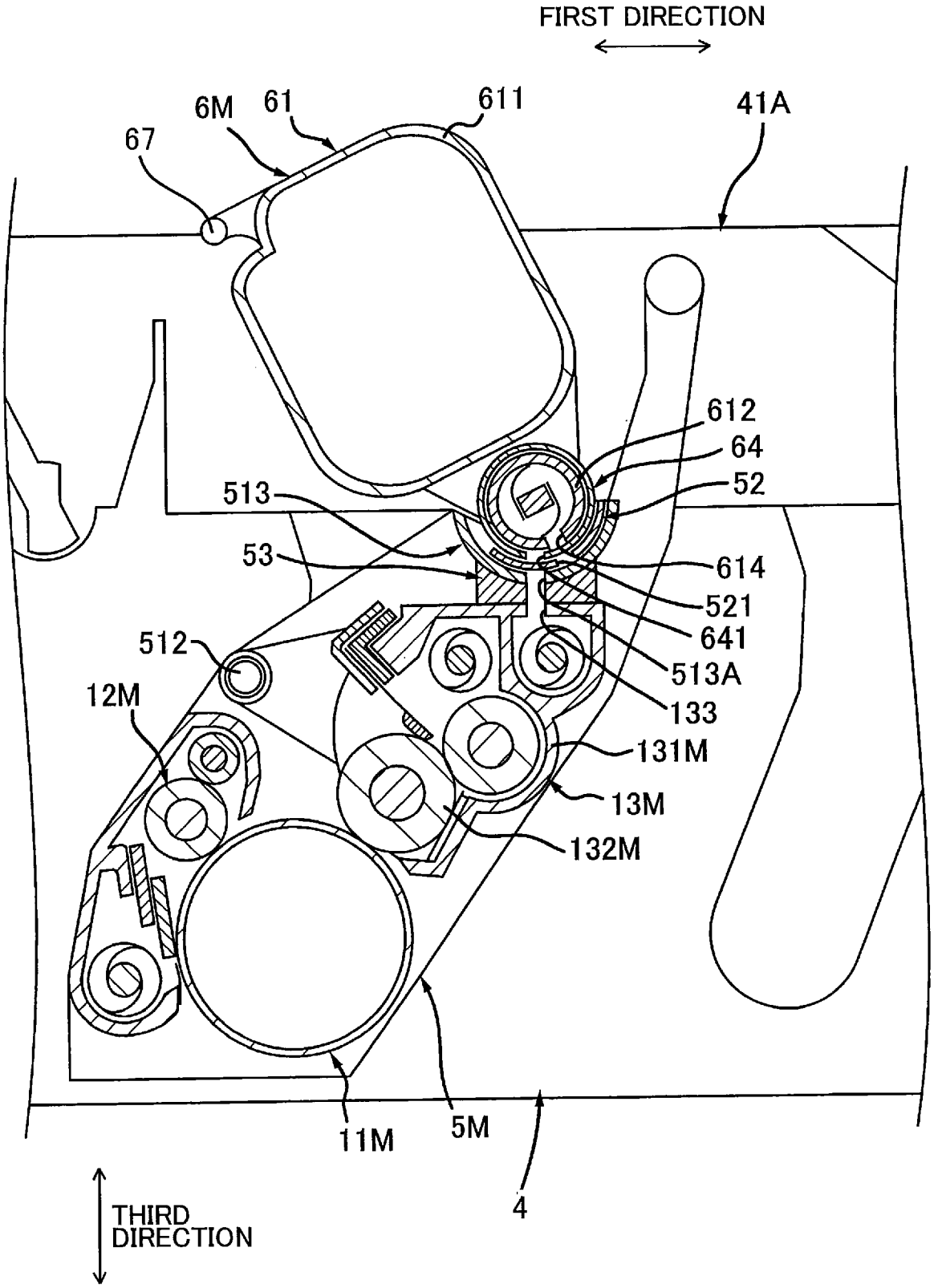
FIG. 13 is an explanatory view illustrating attachment of the toner cartridge to the process cartridge mounted on the drawer according to the embodiment, wherein the toner cartridge is at a first position.
Figure 14:
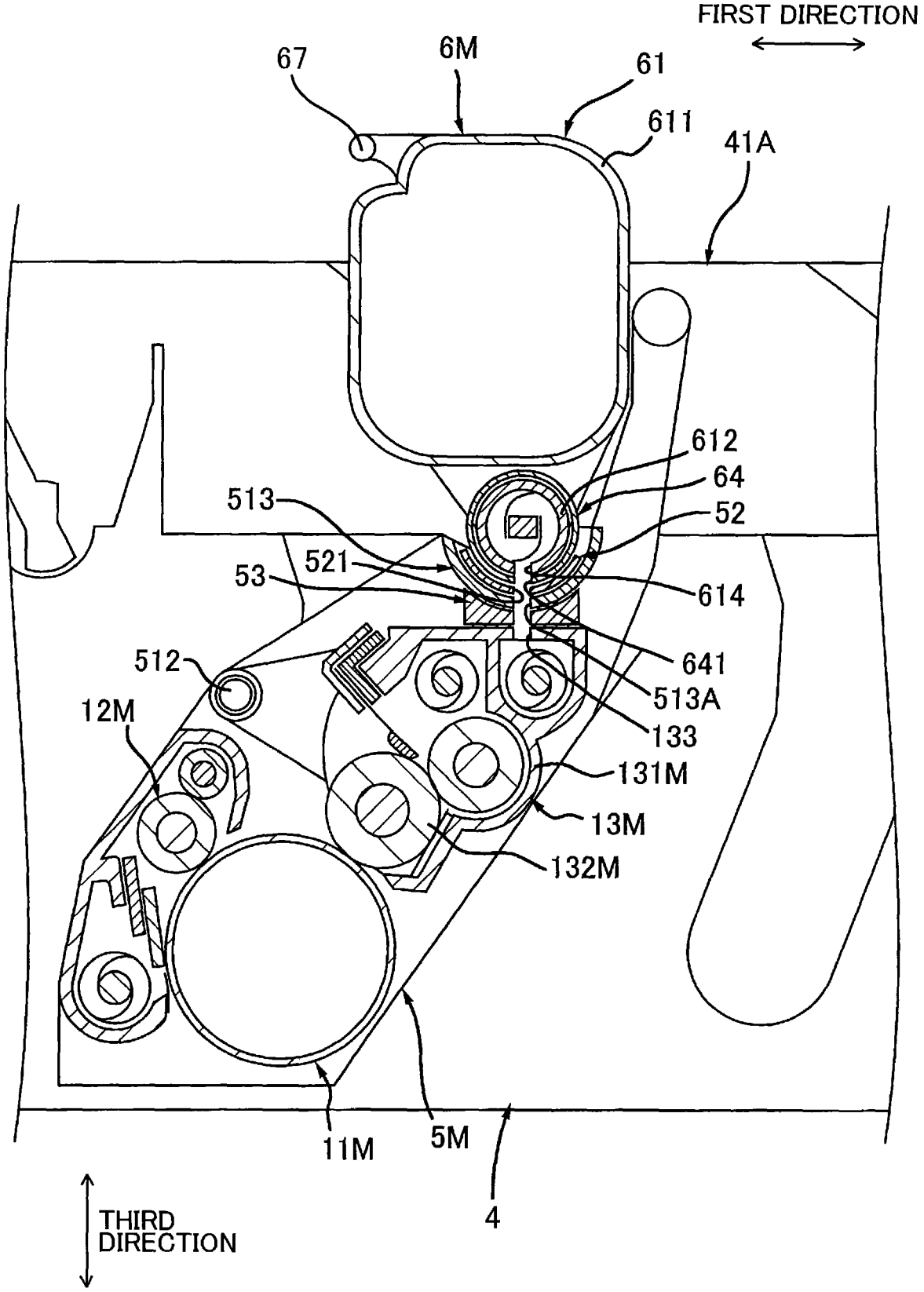
FIG. 14 is an explanatory view illustrating attachment of the toner cartridge to the process cartridge mounted on the drawer according to the embodiment, wherein the toner cartridge is at a second position.
Figure 15:
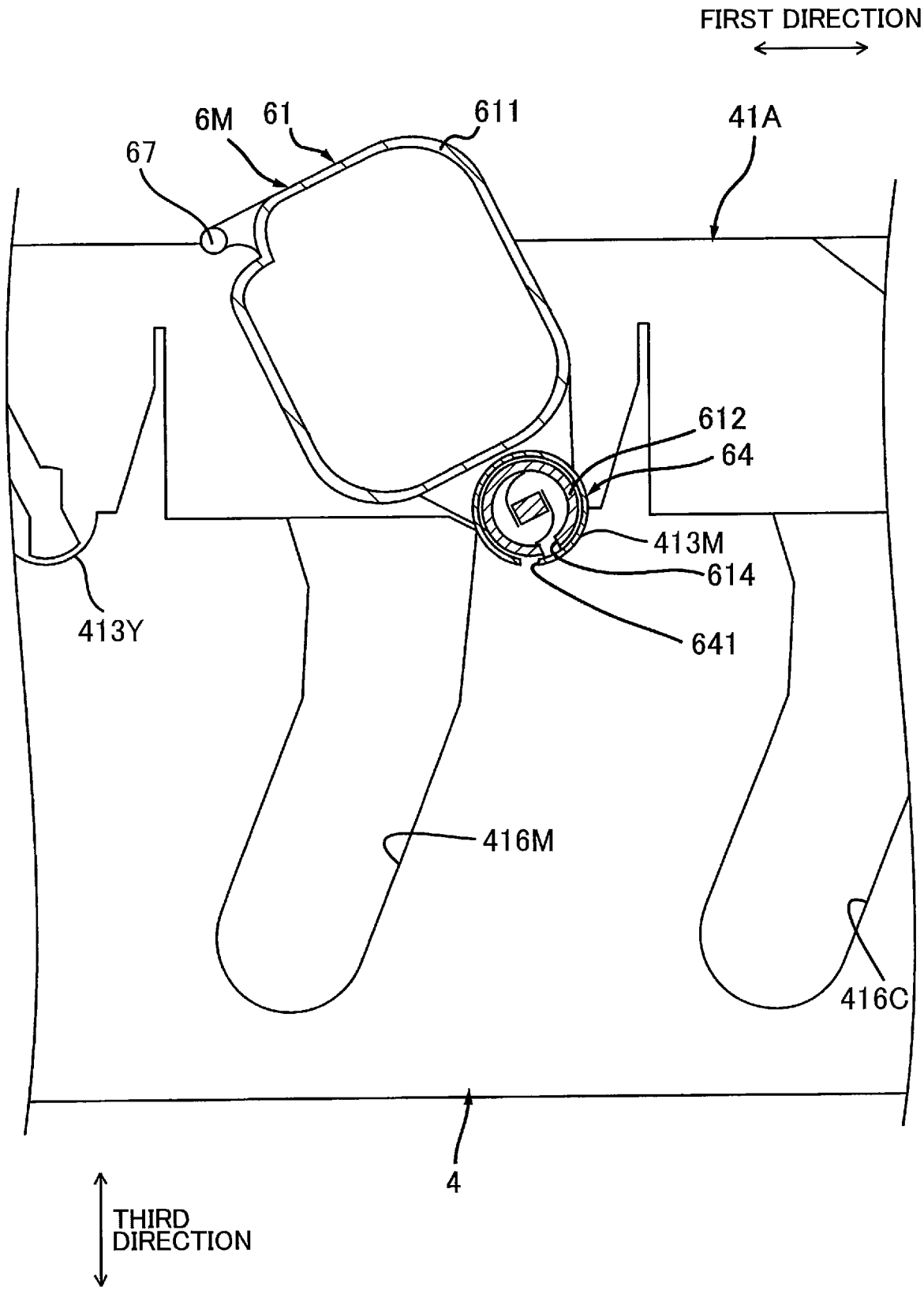
FIG. 15 is an explanatory view illustrating attachment of the toner cartridge to the drawer according to the embodiment without the process cartridge, wherein the toner cartridge is at the second position.
Figure 16:
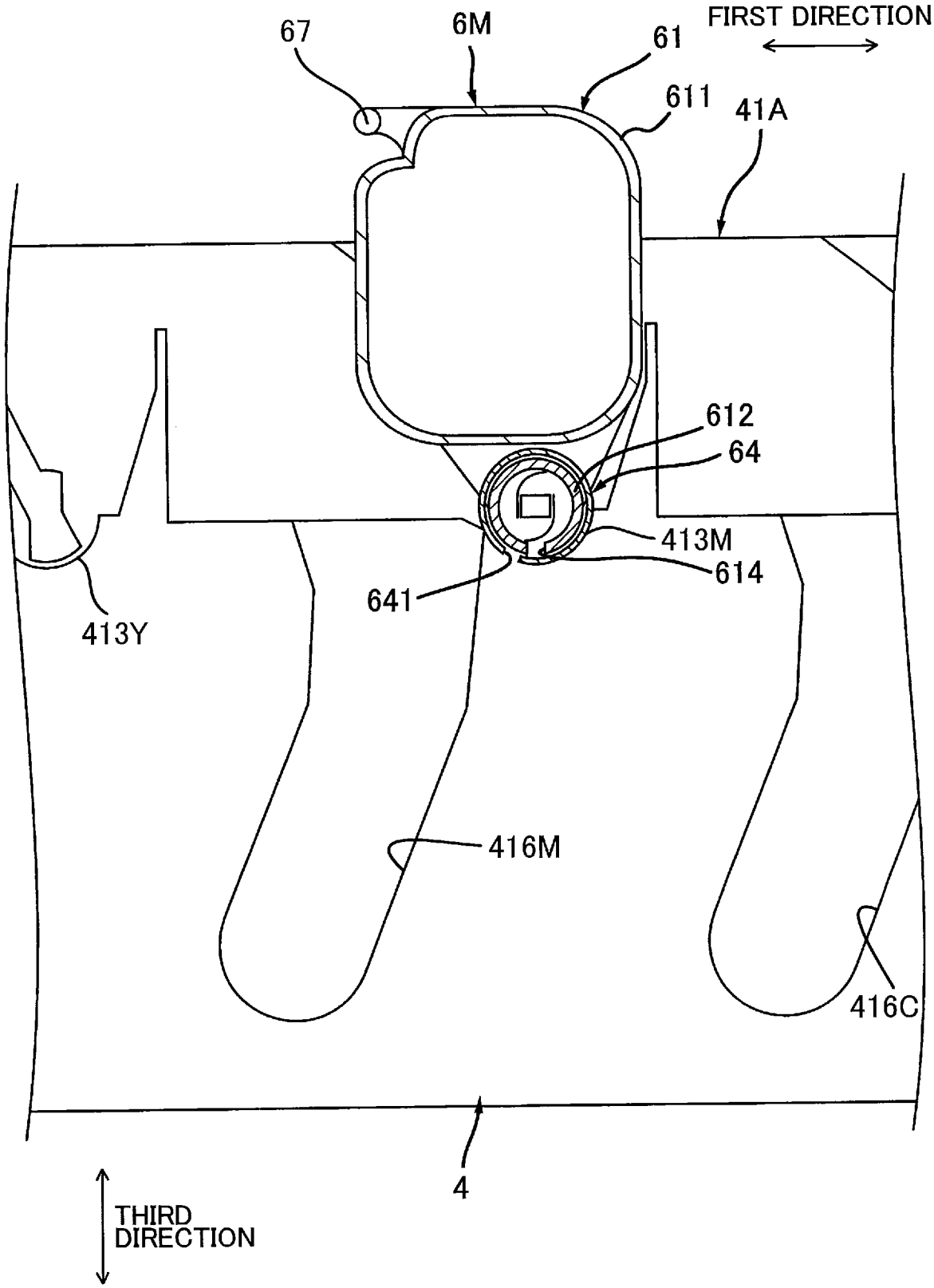
FIG. 16 is an explanatory view illustrating attachment of the toner cartridge to the drawer according to the embodiment without the process cartridge, wherein the toner cartridge is at the second position.

As illustrated in FIGS. 13 and 14, the toner casing 61 is movable between a first position (see FIG. 13) and a second position (see FIG. 14) relative to the drawer 4 in the state where the process cartridge 5M is mounted on the drawer 4 and the toner cartridge 6M is attached to the process cartridge 5M. Further, as illustrated in FIGS. 15 and 16, the toner casing 61 is also movable between the first position (see FIG. 15) and the second position (see FIG. 16) relative to the drawer 4 in the state where the toner cartridge 6M alone is mounted on the drawer 4 without the process cartridge 5M mounted on the drawer 4. The toner cartridge 6M can be removed from the drawer 4 while the toner casing 61 is at the first position (FIG. 13 or FIG. 15).

As illustrated in FIGS. 11 and 12, the toner casing 61 includes a first container 611, the second container 612, and two connecting portions 613A and 613B.

The first container 611 extends in the second direction. The first container 611 has a generally cylindrical shape. Specifically, the first container 611 has a generally rectangular shape in cross section. The first container 611 can store toner therein. The first container 611 has a volume larger than a volume of the second container 612. A grip 67 is also provided at one end portion of the first container 611 in the third direction.

Figure 17B:
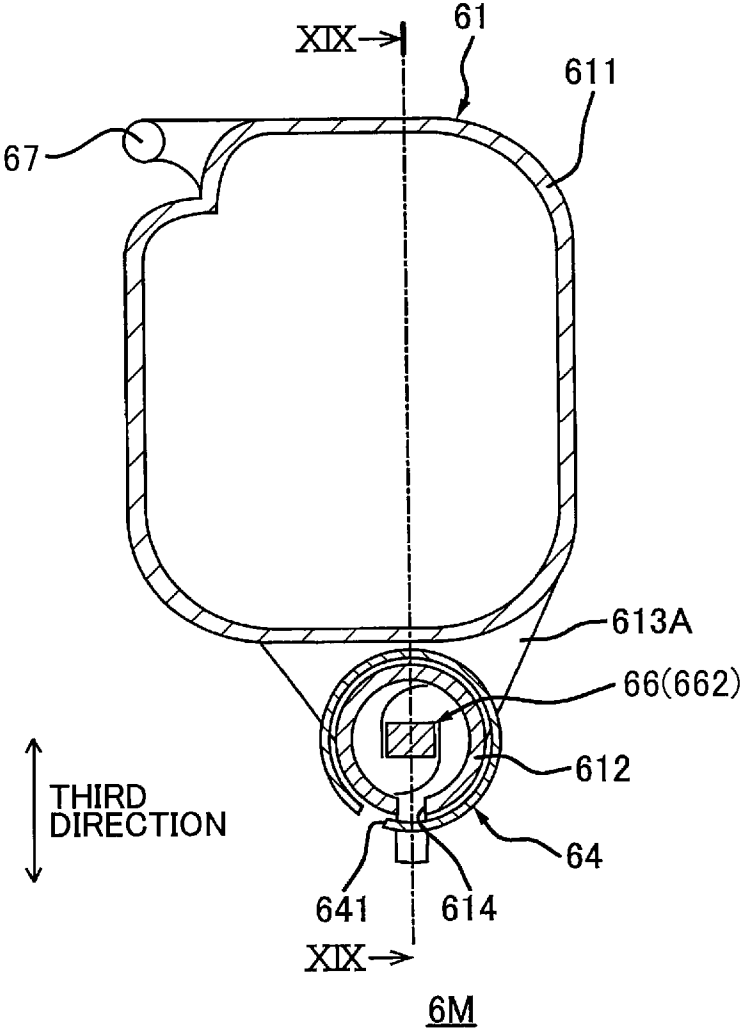
FIG. 17B is a cross-sectional view of the toner cartridge according to the embodiment taken along a plane XVIIB-XVIIB in FIG. 12.
Figure 17A:
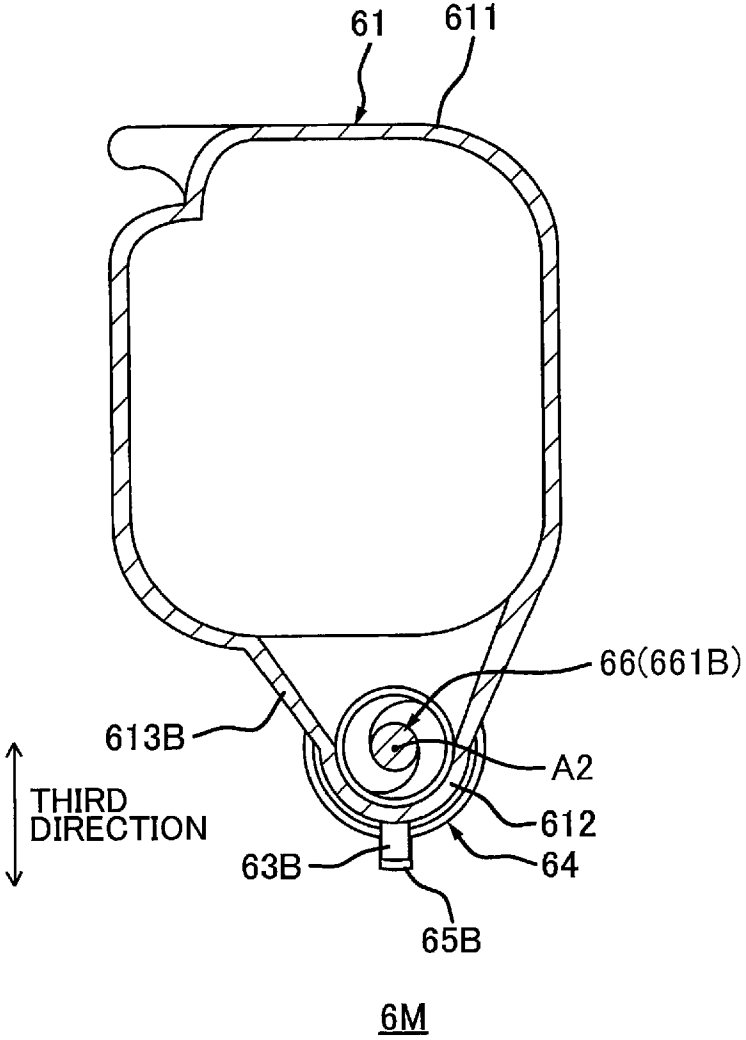
FIG. 17A is a cross-sectional view of the toner cartridge according to the embodiment taken along a plane XVIIA-XVIIA in FIG. 12.

As illustrated in FIGS. 11, 17A, and 17B, the second container 612 is spaced apart from the first container 611 in the third direction. The second container 612 is positioned opposite the grip 67 with respect to the first container 611 in the third direction.

As illustrated in FIGS. 13 and 14, the second container 612 is fitted with the process cartridge 5M mounted in the drawer 4. In other words, the receiving part 513 of the process cartridge 5M receives the second container 612 when the toner cartridge 6M is attached to the process cartridge 5M. The toner casing 61 is pivotable about the second container 612 in the state where the toner cartridge 6M is attached to the process cartridge 5M.

On the other hand, as illustrated in FIGS. 15 and 16, the second container 612 is fitted in the support portion 413M of the drawer side plate 41A and the support portion 413M of the drawer side plate 41B in the state where the toner cartridge 6M is mounted on the drawer 4 while the process cartridge 5M is removed from the drawer 4. The toner casing 61 is pivotable about the second container 612 in the state where the toner cartridge 6M alone is mounted on the drawer 4.

As illustrated in FIG. 11, the second container 612 extends in the second direction. The second container 612 has a cylindrical shape. The second container 612 has the toner discharge opening 614. To rephrase, the toner casing 61 has the toner discharge opening 614.

The toner discharge opening 614 is formed in a middle portion of the second container 612 in the second direction. The toner discharge opening 614 is positioned between the projection 63A and the projection 63B in the second direction. The toner discharge opening 614 is elongated in the second direction. The toner in the second container 612 can be discharged through the toner discharge opening 614.

The connecting portion 613A is provided between one end portion in the second direction of the first container 611 and one end portion in the second direction of the second container 612. The connecting portion 613A connects the one end portion in the second direction of the first container 611 to the one end portion in the second direction of the second container 612 to provide communication therebetween.

The connecting portion 613B is provided between another end portion in the second direction of the first container 611 and another end portion in the second direction of the second container 612. The connecting portion 613B is spaced apart from the connecting portion 613A in the second direction. The connecting portion 613B connects the other end portion in the second direction of the first container 611 and the other end portion in the second direction of the second container 612 to provide communication therebetween.

The second container 612 is in communication with the first container 611 via the connecting portion 613A. As illustrated in FIG. 17A, the second container 612 is in communication with the first container 611 via the connecting portion 613B. The toner in the first container 611 flows into the second container 612 via the connecting portions 613A and 613B.

As illustrated in FIGS. 11 and 12, the protrusion 62A is positioned at one end portion of the toner cartridge 6M in the second direction. Specifically, the protrusion 62A is provided at the one end portion of the second container 612 in the second direction. The protrusion 62A protrudes outward from the one end portion of the second container 612 in the second direction. The protrusion 62A protrudes in the second direction.

The protrusion 62B is positioned at another end portion of the toner cartridge 6M in the second direction. Specifically, the protrusion 62B is provided at the other end portion of the second container 612 in the second direction. The protrusion 62B protrudes outward from the other end portion of the second container 612 in the second direction. The protrusion 62B protrudes in the second direction.

The protrusion 62A is fitted in the toner guide 417M of the drawer side plate 41A (FIG. 5) and the protrusion 62B is fitted in the toner guide 417M of the drawer side plate 41B, in the state where the process cartridge 5M is mounted on the drawer 4 and the toner cartridge 6M is attached to the process cartridge 5M (the state of FIG. 13); or in the state where the toner cartridge 6M is mounted on the drawer 4 from which the process cartridge 5M has been removed (the state of FIG. 15).

Further, the protrusion 62A is fitted in the lock portion 414M of the drawer side plate 41A (see FIG. 5) and the protrusion 62B is fitted in the lock portion 414M of the drawer side plate 41B, in the state where the toner cartridge 6M is attached to the process cartridge 5M mounted on the drawer 4 and the toner cartridge 6M is at the second position (in the state of FIG. 14); or in the state where the toner cartridge 6M alone is mounted on the drawer 4 without the process cartridge 5M and the toner casing 61 is at the second position (in the state of FIG. 16).

As the protrusion 62A is fitted with the lock portion 414M of the drawer side plate 41A and the protrusion 62B is fitted with the lock portion 414M of the drawer side plate 41B, the toner cartridge 6M is locked (immovable) relative to the drawer 4. In other words, the toner cartridge 6M is locked and immovable relative to the drawer 4 while the toner casing 61 is at the second position.

On the other hand, when the protrusion 62A is disengaged from the lock portion 414M of the drawer side plate 41A and the protrusion 62B is disengaged from the lock portion 414M of the drawer side plate 41B, the toner cartridge 6M becomes unlocked from the drawer 4. In other words, the toner cartridge 6M becomes unlocked from the drawer 4 so as to be movable relative to the drawer 4 while the toner cartridge 6M is at the first position.

The projection 63A is positioned between the toner discharge opening 614 and the protrusion 62A in the second direction. The projection 63A is positioned between the shutter 64 and the protrusion 62A in the second direction. The projection 63A is positioned opposite the first container 611 with respect to the second container 612 in the third direction. The projection 63A extends from a peripheral surface of the second container 612.

The projection 63B is spaced apart from the projection 63A in the second direction. The projection 63B is positioned opposite the projection 63A with respect to the toner discharge opening 614 in the second direction. The projection 63B is positioned between the toner discharge opening 614 and the protrusion 62B in the second direction. The projection 63B is positioned opposite the projection 63A with respect to the shutter 64 in the second direction. The projection 63B is positioned between the shutter 64 and the protrusion 62B in the second direction. The projection 63B is positioned opposite the first container 611 with respect to the second container 612 in the third direction. The projection 63B extends from the peripheral surface of the second container 612.

In the state where the toner cartridge 6M is attached to the process cartridge 5M, the projection 63A is fitted in the through-hole 523A of the shutter 52 (FIG. 7) and the projection 63B is fitted in the through-hole 523B of the shutter 52 (FIG. 7). With the projection 63A fitted in the through-hole 523A and the projection 63B fitted in the through-hole 523B of the shutter 52, the shutter 52 is made movable together with the toner casing 61. The shutter 52 is thus allowed to move from the closed position to the open position in conjunction with the movement of the toner casing 61 from the first position to the second position; and from the open position to the closed position in conjunction with the movement of the toner casing 61 from the second position to the first position.

The shutter 64 is positioned between the connecting portion 613A and the connecting portion 613B in the second direction. The shutter 64 is provided over the peripheral surface of the second container 612.

Figure 18:
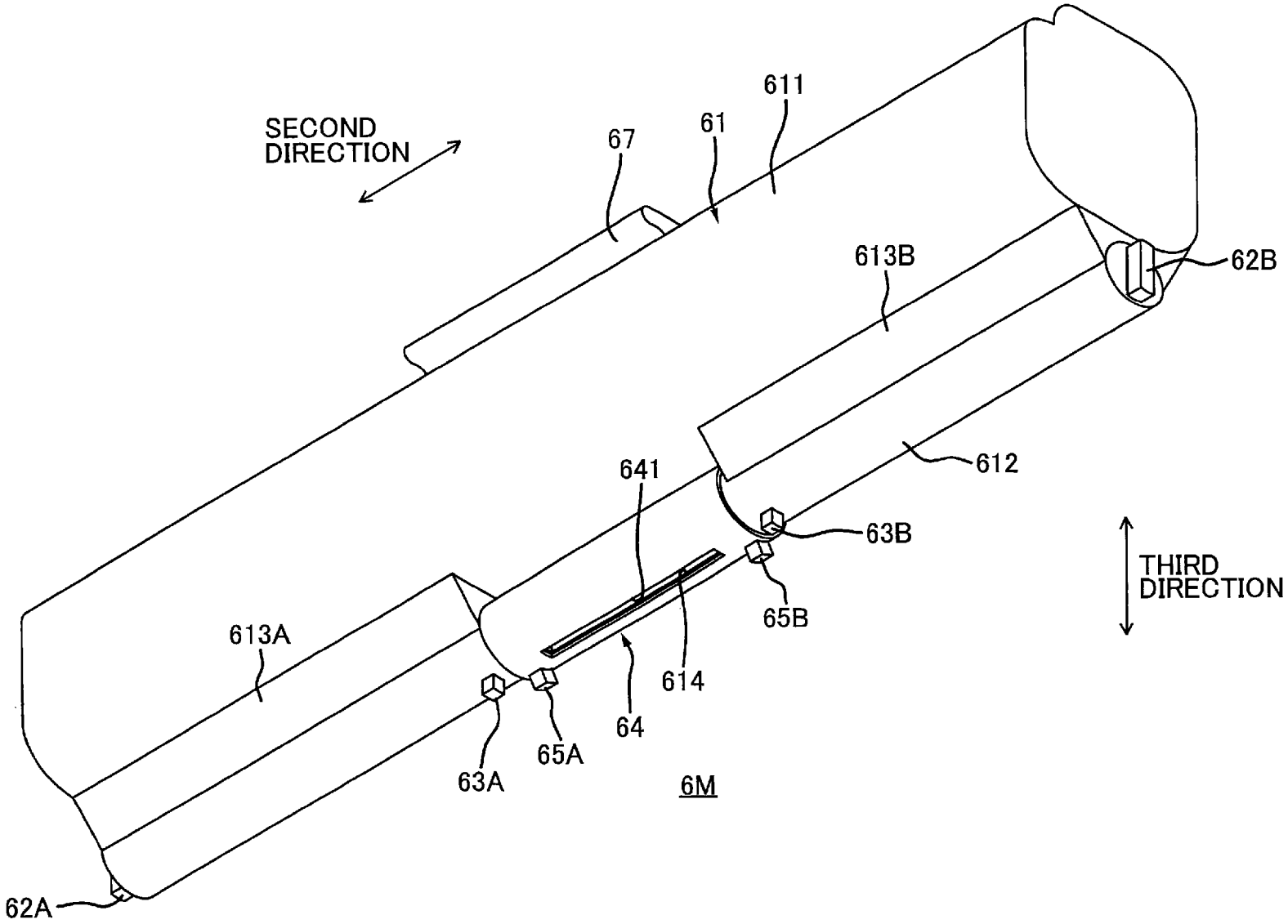
FIG. 18 is a perspective view of the toner cartridge according to the embodiment, wherein the shutter of the toner cartridge is at an open position.

As illustrated in FIGS. 11 and 18, the shutter 64 is movable between a closed position (illustrated in FIG. 11) and an open position (illustrated in FIG. 18) relative to the toner discharge opening 614. As illustrated in FIG. 11, the shutter 64 covers the toner discharge opening 614 when the shutter 64 is at the closed position. As illustrated in FIG. 18, the toner discharge opening 614 is exposed when the shutter 64 is at the open position.

As illustrated in FIGS. 13 and 14, in the state where the process cartridge 5M is mounted on the drawer 4 and the toner cartridge 6M is attached to the process cartridge 5M, the shutter 64 is at the closed position when the toner casing 61 is at the first position (FIG. 13); and the shutter 64 is at the open position when the toner casing 61 is at the second position (FIG. 14).

As illustrated in FIGS. 15 and 16, in the state where the process cartridge 5M is removed from the drawer 4 and the toner cartridge 6M alone is mounted on the drawer 4, the shutter 64 is at the closed position when the toner casing 61 is at the first position (FIG. 15) and also when the toner casing 61 is at the second position (FIG. 16).

As illustrated in FIG. 11, the shutter 64 extends in the second direction. The shutter 64 has a cylindrical shape in conformance with the peripheral surface of the second container 612. The shutter 64 has an opening 641.

The opening 641 is elongated in the second direction. The opening 641 is at least partially in communication with the toner discharge opening 614 when the shutter 64 is at the open position, as illustrated in FIG. 18. The opening 641 is displaced from the toner discharge opening 614 when the shutter 64 is at the closed position, as illustrated in FIG. 11.

The projection 65A is provided on a peripheral surface of the shutter 64. The projection 65A protrudes from the peripheral surface of the shutter 64. That is, the shutter 64 includes the projection 65A. The projection 65A is positioned between the opening 641 and the projection 63A in the second direction.

The projection 65B is spaced apart from the projection 65A in the second direction. The projection 65B is positioned opposite the projection 65A with respect to the opening 641 in the second direction. The projection 65B is provided on the peripheral surface of the shutter 64. The projection 65B protrudes from the peripheral surface of the shutter 64. The projection 65B is positioned between the opening 641 and the projection 63B in the second direction.

In the state where the toner cartridge 6M is attached to the process cartridge 5M, the projection 65A penetrates through the through-hole 522A of the shutter 52 and is received in the hole 513B of the receiving part 513; and the projection 65B penetrates through the through-hole 522B of the shutter 52 and is received in the hole 513C of the receiving part 513 (see FIG. 7).

In this way, the projection 65A is fitted in the hole 513B of the receiving part 513 and the projection 65B is fitted in the hole 513C of the receiving part 513 in the state where the process cartridge 5M is mounted on the drawer 4 and the toner cartridge 6M is attached to the process cartridge 5M. With this structure, the shutter 64 is fixed (immovable) relative to the receiving part 513. That is, the shutter 64 is fixed (immovable) relative to the process cartridge 5M in the state where the process cartridge 5M is mounted on the drawer 4 and the toner cartridge 6M is attached to the process cartridge 5M.

The toner casing 61 is therefore movable relative to the shutter 64 fixed to the receiving part 513 as the toner casing 61 moves between the first position and the second position, as illustrated in FIGS. 13 and 14.

Specifically, the shutter 64 moves to the open position, relative to the toner casing 61, in accordance with the movement of the toner casing 61 from the first position to the second position. Further, the shutter 64 moves to the closed position, relative to the toner casing 61, in accordance with the movement of the toner casing 61 from the second position to the first position.

Consequently, in the state where the process cartridge 5M is mounted on the drawer 4 and the toner cartridge 6M is attached to the process cartridge 5M, the shutter 64 is at the closed position when the toner casing 61 is at the first position (as illustrated in FIG. 13), and the shutter 64 is at the open position when the toner casing 61 is at the second position (as illustrated in FIG. 14).

Here, for a comparative purpose, assume a typical toner cartridge in which a toner discharge opening and a shutter are located at a downstream end portion of the toner cartridge in an attaching direction of the toner cartridge to a process cartridge. In this type of toner cartridge, a lever for opening the shutter is provided to extend from the shutter toward an upstream end portion of the toner cartridge in the attaching direction.

In this toner cartridge, the lever may be operated accidentally to open the shutter before the toner cartridge is attached to the process cartridge, which may result in toner leakage. Also, any damage to the lever may be conceivable in this toner cartridge. In particular, if a sealing member is provided between the shutter and a toner casing in this toner cartridge in order to prevent toner leakage, the lever needs to move the shutter against pressure from the sealing member. Accordingly, the lever may be damaged unless the lever has sufficiently high rigidity.

In this respect, in the present embodiment, the shutter 64 is movable between the open position and the closed position in accordance with the pivoting of the toner casing 61 with the shutter 64 fixed to the receiving part 513 of the process cartridge 5M, as illustrated in FIGS. 13 and 14.

Hence, the user only needs to perform attachment of the toner cartridge 6M to the process cartridge 5M for opening the shutter 64, without performing any other operation to open the shutter 64. In other words, the user cannot perform the operation to open the shutter 64 alone, independently of the operation to attach the toner cartridge 6M to the process cartridge 5M. With this configuration, accidental opening of the shutter 64 can be prevented, and, hence, accidental toner leakage from the toner cartridge 6M is unlikely to occur.

Further, since no lever is required for opening the shutter 64, accidental damage to the lever would not happen.

Still further, the user can hold an upstream end portion of the toner casing 61 in the attaching direction of the toner cartridge 6M (i.e., the grip 67) to pivot the toner casing 61 as a whole about the second container 612 (downstream end portion of the toner casing 61 in the attaching direction). Accordingly, the user can open the shutter 64 with smaller force, by utilizing the principle of leverage. In particular, even in a case where a sealing member is provided between the shutter 64 and the toner casing 61 in order to prevent toner leakage from the toner cartridge 6M storing toner of high fluidity, the user can still open the shutter 64 easily.

In contrast, as illustrated in FIGS. 15 and 16, in the state where the toner cartridge 6M alone is mounted on the drawer 4 with the process cartridge 5M removed from the drawer 4, the shutter 64 is not positionally fixed to the drawer 4.

Therefore, the shutter 64 moves along with the toner casing 61 as the toner casing 61 moves from the first position to the second position.

Consequently, in the state where the process cartridge 5M is removed from the drawer 4 and the toner cartridge 6M is mounted on the drawer 4, the shutter 64 is maintained at the closed position when the toner casing 61 is at the first position (see FIG. 15) and also when the toner casing 61 is at the second position (see FIG. 16).

With this structure, when the toner cartridge 6M alone is mounted on the drawer 4 with the process cartridge 5M detached from the drawer 4, the shutter 64 is prevented from being opened, thereby preventing toner leakage from the toner cartridge 6M.

Figure 19:
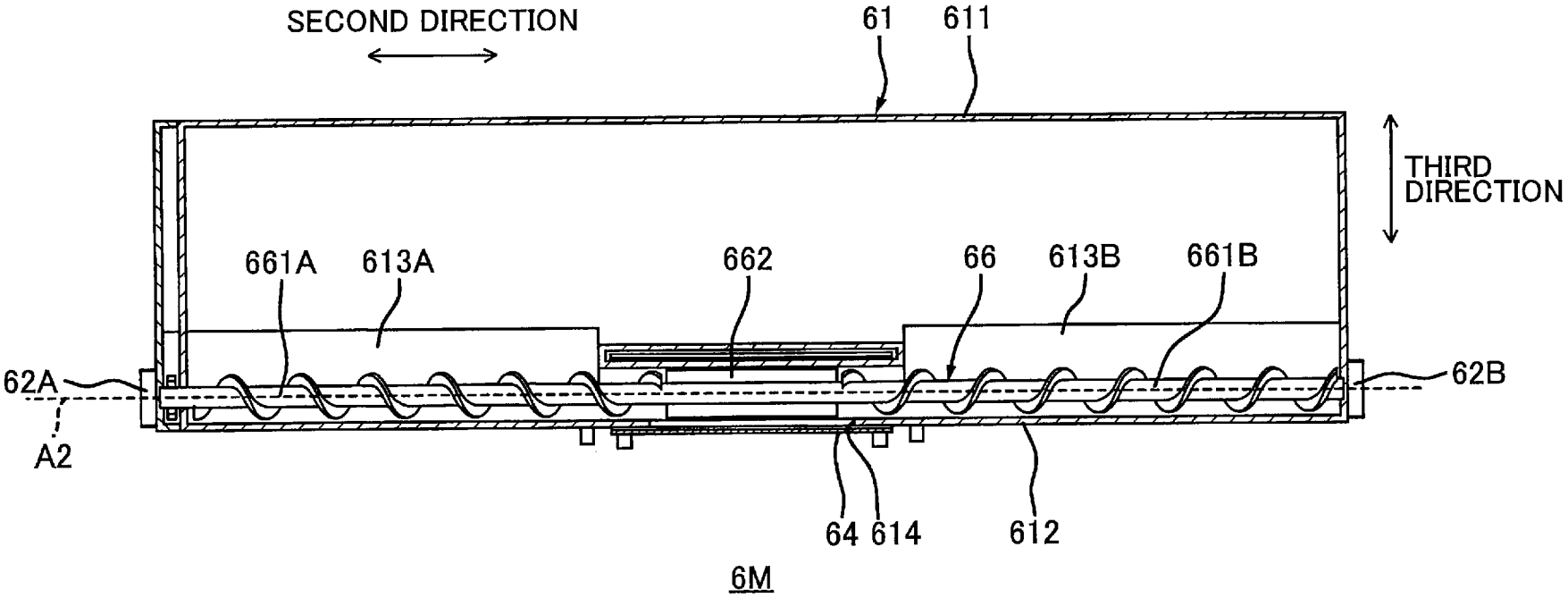
FIG. 19 is a cross-sectional view of the toner cartridge according to the embodiment taken along a plane XIX-XIX in FIG. 17B.

As illustrated in FIG. 19, the toner conveying member 66 is provided inside the second container 612. The toner conveying member 66 is rotatable about an axis A2 extending in the second direction. The toner conveying member 66 extends along the axis A2. The toner conveying member 66 includes two screw portions 661A and 661B and a propeller portion 662.

The screw portion 661A is positioned at one end portion of the toner conveying member 66 in the second direction. The screw portion 661A extends in the second direction. The screw 661A is configured to convey, toward the toner discharge opening 614, the toner that has entered the second container 612 via the connecting portion 613A.

The screw portion 661B is positioned at another end portion of the toner conveying member 66 in the second direction. The screw portion 661B is spaced apart from the screw portion 661A in the second direction. The screw portion 661B extends in the second direction. The screw 661B is configured to convey, toward the toner discharge opening 614, the toner that has entered the second container 612 via the connecting portion 613B.

The propeller portion 662 is positioned between the screw portion 661A and the screw portion 661B in the second direction.

6. Operational and Technical Advantages (1) In the image-forming apparatus 1 according to the present embodiment, the drawer 4 is movable between the inner position (FIG. 2) and the outer position (FIG. 3) in the state where the toner cartridge 6M is mounted on the drawer 4 while the process cartridge 5M is removed from the drawer 4 (in the state of FIG. 4).

With this structure, the drawer 4 is allowed to move between the inner position and the outer position relative to the main casing 2 even in a case where the toner cartridge 6M is inadvertently mounted on the drawer 4 without attachment of the process cartridge 5M to the drawer 4. Consequently, damage to at least one of the toner cartridge 6M, the drawer 4, and the main casing 2 can be suppressed.

(2) According to the image-forming apparatus 1, as illustrated in FIG. 4, when the toner cartridge 6M is mounted on the drawer 4 in the state where the process cartridge 5M is removed from the drawer 4, the toner cartridge 6M is supported by the drawer 4 with both end portions in the second direction of the toner cartridge 6M supported by the respective support portions 413M of the drawer side plate 41A and the drawer side plate 41B.

That is, the toner cartridge 6M can be stably supported by the drawer 4, even when the toner cartridge 6M alone is mounted on the drawer 4 in the state where the process cartridge 5M is removed from the drawer 4, i.e., even when a user accidentally mounts the toner cartridge 6M on the drawer 4 from which the process cartridge 5M has been removed.

(3) According to the image-forming apparatus 1, the receiving part 513 of the process cartridge 5M mounted on the drawer 4 is positioned slightly higher than the support portions 413M of the drawer side plates 41A and 41B, as illustrated in FIG. 8. With this structure, in the state where the process cartridge 5M is mounted on the drawer 4 and the toner cartridge 6M is attached to the process cartridge 5M (in the states of FIGS. 13 and 14), the receiving part 513 of the process cartridge 5M is in contact with the second container 612 of the toner cartridge 6M, but each of the support portions 413M of the drawer side plates 41A and 41B is spaced apart from the second container 612 in the third direction.

This structure of the embodiment enables the second container 612 of the toner cartridge 6M to reliably make contact with the receiving part 513 of the process cartridge 5M in the state where the toner cartridge 6M is attached to the process cartridge 5M mounted on the drawer 4.

(4) According to the image-forming apparatus 1 of the embodiment, the sealing member 53 is provided between the receiving part 513 and the developing casing 131M to enclose the toner receiving opening 513A and the opening 133, as illustrated in FIGS. 7 and 10.

With this structure, the toner flowing from the toner receiving opening 513A toward the opening 133 can be prevented from leaking from the region between the receiving part 513 and the developing casing 131M.

More specifically, the sealing member 53 is made of sponge. The sealing member 53 is provided between the developing casing 131M and the receiving part 513 in a slightly compressed state. Here, the "slightly compressed state" means such a state of compression that the sealing member 53 can be further compressed by the developing casing 131M when the developing casing 131M moves to approach the receiving part 513.

With this structure, when the developing casing 131M moves away from the receiving part 513, the sealing member 53 restores from the slightly compressed state, thereby preventing formation of a gap between the developing casing 131M and the receiving part 513. Consequently, toner leakage from between the developing casing 131M and the receiving part 513 can be restrained.

Further, the sealing member 53 can be compressed further when the developing casing 131M approaches the receiving part 513. The compressed sealing member 53 can prevent a gap from being formed between the developing casing 131M and the receiving part 513, thereby suppressing toner leakage from between the developing casing 131M and the receiving part 513.

Further, the sealing member 53 can be further compressed when the developing casing 131M approaches the receiving part 513. That is, provision of the sealing member 53 does not hinder movement of the developing casing 131M.

(5) According to the image-forming apparatus 1, in the state where the process cartridge 5M is mounted on the drawer 4 as illustrated in FIG. 8, the grip 514 is positioned closer to the open end of the drawer 4 than the support portions 413M of the drawer side plates 41A and 41B are to the open end of the drawer 4 in the third direction. That is, the user can access the process cartridge 5M on the drawer 4 from above, i.e., from the side at which the drawer 4 is opened in the third direction.

With this configuration, the user can easily hold the grip 514 from above via the open end of the drawer 4 in the state where the process cartridge 5M is mounted on the drawer 4. Thus, the user can easily remove the process cartridge 5M mounted in the drawer 4 from the drawer 4.

(6) According to the image-forming apparatus 1, in the state where the process cartridge 5M is mounted on the drawer 4 and the toner cartridge 6M is attached to the process cartridge 5M as illustrated in FIGS. 13 and 14, the shutter 64 is at the closed position while the toner casing 61 is at the first position (see FIG. 13); and the shutter 64 is at the open position while the toner casing 61 is at the second position (see FIG. 14).

On the other hand, in the state the process cartridge 5M is removed from the drawer 4 and the toner cartridge 6M alone is mounted on the drawer 4 as illustrated in FIGS. 15 and 16, the shutter 64 is maintained at the closed position regardless of whether the toner casing 61 is at the first position (FIG. 15) or at the second position (FIG. 16).

This configuration can prevent accidental opening of the shutter 64 in the state where the process cartridge 5M is removed from the drawer 4 and the toner cartridge 6M alone is mounted on the drawer 4, thereby preventing toner leakage from the process cartridge 5M mounted on the drawer 4.

While the description has been made in detail with reference to the embodiments, it would be apparent to those skilled in the art that many modifications and variations may be made thereto.

[Remarks]

The image-forming apparatus 1 is an example of an image-forming apparatus. The main casing 2 is an example of a main casing. The drawer 4 is an example of a drawer. The process cartridge 5M is an example of a process cartridge. The toner cartridge 6M is an example of a toner cartridge. The photosensitive drum 11M is an example of a photosensitive drum. The developing device 13M is an example of a developing device. The developing casing 131M is an example of a developing casing. The developing roller 132M is an example of a developing roller. The sealing member 53 is an example of a sealing member. The grip 514 is an example of a grip. The drawer side plates 41A and 41B are examples of a first drawer side plate and a second drawer side plate, respectively. The first part 411 and second part 412 are examples of a first part and a second part, respectively. The support portion 413M of the drawer side plate 41A is an example of a first support portion. The support portion 413M of the drawer side plate 41B is an example of a second support portion. The first container 611 is an example of a first container. The second container 612 is an example of a second container. The receiving part 513 is an example of a receiving part. The toner casing 61 is an example of a toner casing, and the toner discharge opening 614 is an example of a toner receiving opening. The shutter 64 is an example of a shutter. The projections 65A, 65B are an example of a projection of the shutter.

What is claimed is:

1. An image-forming apparatus comprising:

a main casing;

a drawer movable in a first direction between an inner position and an outer position relative to the main casing, the drawer being accommodated in the main casing at the inner position, and at least a part of the drawer being located outside the main casing at the outer position;

a process cartridge detachably mountable on the drawer in a mounting direction, the process cartridge comprising a photosensitive drum rotatable about a drum axis, the drum axis extending in a second direction crossing the first direction when the process cartridge is mounted on the drawer, and a developing device configured to supply toner to the photosensitive drum; and a toner cartridge configured to store the toner, the toner cartridge being detachably mountable on the drawer without attachment of the process cartridge on the drawer, wherein the drawer has an open end that is open in a third direction crossing the first direction and the second direction, wherein the drawer comprises a process guide extending in the mounting direction for guiding attachment and detachment of the process cartridge relative to the drawer, the process guide having one end and another end in the mounting direction, the one end being closer to the open end than the another end is to the open end in the third direction, and a toner guide for guiding attachment and detachment of the toner cartridge relative to the drawer, the toner guide extending in a fourth direction crossing the mounting direction, the toner guide having one end and another end in the fourth direction, the one end of the toner guide being positioned closer to the open end than the another end of the toner guide is to the open end in the third direction, and wherein the one end of the toner guide is positioned closer to the open end than the one end of the process guide is to the open end in the third direction.

2. The image-forming apparatus according to claim 1, wherein the drawer comprises:

a first drawer side plate including a first support portion; and a second drawer side plate spaced away from the first drawer side plate in the second direction, the second drawer side plate including a second support portion, wherein the toner cartridge extends in the second direction and has a first end portion and a second end portion in the second direction, and wherein, when the toner cartridge is mounted on the drawer, the first support portion supports the first end portion in the second direction of the toner cartridge and the second support portion supports the second end portion in the second direction of the toner cartridge.

3. The image-forming apparatus according to claim 2, wherein the toner cartridge comprises a toner casing extending in the second direction, the toner casing comprising:

a first container configured to store the toner; and a second container in communication with the first container, the second container having a toner discharge opening for discharging the toner, the second container having one end portion and another end portion in the second direction, wherein, when the toner cartridge is mounted on the drawer, the first support portion supports the one end portion in the second direction of the second container and the second support portion supports the another end portion in the second direction of the second container.

4. The image-forming apparatus according to claim 3, wherein the process cartridge comprises a receiving part configured to receive the second container of the toner cartridge in a state where the toner cartridge is attached to the process cartridge, the receiving part having a toner receiving opening configured to communicate with the toner discharge opening in the state where the toner cartridge is attached to the process cartridge, and wherein, when the process cartridge is mounted on the drawer, the first support portion, the second support portion and the receiving part are arrayed in the second direction.

5. The image-forming apparatus according to claim 4, wherein, when the process cartridge is mounted on the drawer and the toner cartridge is attached to the process cartridge, the receiving part is in contact with the second container, and the first support portion and the second support portion are spaced apart from the second container.

6. The image-forming apparatus according to claim 4, wherein the developing device comprises:

a developing casing having an opening in communication with the toner receiving opening and configured to store the toner supplied from the toner cartridge; and a developing roller configured to supply the toner stored in the developing casing to the photosensitive drum, wherein the process cartridge further comprises a sealing member positioned between the receiving part and the developing casing to provide sealing therebetween, the sealing member enclosing the toner receiving opening and the opening of the developing casing.

7. The image-forming apparatus according to claim 2, wherein each of the first drawer side plate and the second drawer side plate comprises a first part including the process guide, and a second part including the toner guide, the second part being positioned closer to the open end than the first part is to the open end in the third direction, and wherein the second part of the first drawer side plate and the second part of the second drawer side plate define therebetween a distance in the second direction greater than a distance in the second direction defined between the first part of the first drawer side plate and the first part of the second drawer side plate.

8. The image-forming apparatus according to claim 7, wherein the first support portion is provided at one end portion of the first part of the first drawer side plate in the third direction, and wherein the second support portion is provided at one end portion of the first part of the second drawer side plate in the third direction.

9. The image-forming apparatus according to claim 7, wherein the process cartridge further comprises a grip, wherein, when the process cartridge is mounted on the drawer, the grip is positioned closer to the open end of the drawer than each of the first support portion and the second support portion is to the open end of the drawer in the third direction.

10. The image-forming apparatus according to claim 1, wherein the toner cartridge comprises:

a toner casing configured to store the toner and having a toner discharge opening for discharging the toner; and a shutter movable relative to the toner discharge opening between an open position opening the toner discharge opening and a closed position closing the toner discharge opening, wherein the toner casing is movable relative to the drawer between a first position and a second position, either when the process cartridge is mounted on the drawer and the toner cartridge is attached to the process cartridge, or when the process cartridge is removed from the drawer and the toner cartridge is mounted on the drawer, wherein, when the process cartridge is mounted on the drawer and the toner cartridge is attached to the process cartridge, the shutter is at the closed position when the toner casing is at the first position, and the shutter is at the open position when the toner casing is at the second position, and wherein, when the process cartridge is removed from the drawer and the toner cartridge is mounted on the drawer, the shutter is maintained at the closed position both when the toner casing is at the first position and when the toner casing is at the second position.

11. The image-forming apparatus according to claim 10, wherein, when the process cartridge is mounted on the drawer and the toner cartridge is attached to the process cartridge, the shutter is fixed in position and immovable relative to the process cartridge.

12. The image-forming apparatus according to claim 11, wherein the shutter comprises a projection, wherein the process cartridge comprises a hole part for receiving the projection of the shutter, and wherein, when the process cartridge is mounted on the drawer and the toner cartridge is attached to the process cartridge, the projection is fitted in the hole part to fix the shutter in position relative to the process cartridge.

13. The image-forming apparatus according to claim 10, wherein the toner cartridge is locked and immovable relative to the drawer when the toner casing is at the second position, and wherein the toner cartridge is unlocked and movable relative to the drawer when the toner casing is at the first position.

14. The image-forming apparatus according to claim 1, wherein the process cartridge mounted on the drawer is restricted from being removed from the drawer when the toner cartridge is attached to the process cartridge mounted on the drawer, and wherein the process cartridge mounted on the drawer is removable from the drawer when the toner cartridge is detached from the process cartridge mounted on the drawer.

15. The image-forming apparatus according to claim 14, wherein the drawer comprises a first drawer side plate and a second drawer side plate spaced away from the first drawer side plate in the second direction, and wherein each of the first drawer side plate and the second drawer side plate comprises a first part including the process guide, and a second part including the toner guide, the second part being positioned closer to the open end than the first part is to the open end in the third direction.

16. The image-forming apparatus according to claim 15, wherein the second part further includes a restricting part extending in the third direction crossing the fourth direction and connected to the toner guide, the restricting part being engageable with the toner cartridge to restrict movement of the toner cartridge relative to the drawer.

17. An image-forming apparatus comprising:

a main casing;

a drawer movable in a first direction between an inner position and an outer position relative to the main casing, the drawer being accommodated in the main casing at the inner position, and at least a part of the drawer being located outside the main casing at the outer position;

a process cartridge detachably mountable on the drawer, the process cartridge comprising a photosensitive drum rotatable about a drum axis, the drum axis extending in a second direction crossing the first direction when the process cartridge is mounted on the drawer, and a developing roller; and a toner cartridge storing the toner, the toner cartridge being detachably mountable on the drawer, the toner cartridge mounted on the drawer being directly supported by the drawer, wherein the drawer comprises a first drawer side plate including a first support portion, and a second drawer side plate spaced away from the first drawer side plate in the second direction, the second drawer side plate including a second support portion, wherein the toner cartridge extends in the second direction and has a first end portion and a second end portion in the second direction, wherein, when the toner cartridge is mounted on the drawer, the first support portion supports the first end portion in the second direction of the toner cartridge and the second support portion supports the second end portion in the second direction of the toner cartridge, wherein the drawer has an open end that is open in a third direction crossing the first direction and the second direction, wherein each of the first drawer side plate and the second drawer side plate comprises a first part including a process guide for guiding attachment and detachment of the process cartridge relative to the drawer, and a second part including a toner guide for guiding attachment and detachment of the toner cartridge relative to the drawer, the second part being positioned closer to the open end than the first part is to the open end in the third direction, and wherein the second part of the first drawer side plate and the second part of the second drawer side plate define therebetween a distance in the second direction greater than a distance in the second direction defined between the first part of the first drawer side plate and the first part of the second drawer side plate.

18. The image-forming apparatus according to claim 17, wherein, when the toner cartridge is mounted on the drawer, the first support portion is contact with the first end portion in the second direction of the toner cartridge and the second support portion is contact with the second end portion in the second direction of the toner cartridge.

19. The image-forming apparatus according to claim 17, wherein the process cartridge mounted on the drawer is restricted from being removed from the drawer when the toner cartridge is attached to the process cartridge mounted on the drawer, and wherein the process cartridge mounted on the drawer is removable from the drawer when the toner cartridge is detached from the process cartridge mounted on the drawer.

20. An image-forming apparatus comprising:

a main casing;

a drawer movable in a first direction between an inner position and an outer position relative to the main casing, the drawer being accommodated in the main casing at the inner position, and at least a part of the drawer being located outside the main casing at the outer position;

a process cartridge detachably mountable on the drawer, the process cartridge comprising a photosensitive drum rotatable about a drum axis, the drum axis extending in a second direction crossing the first direction when the process cartridge is mounted on the drawer, a process frame rotatably supporting the photosensitive drum, a developing device pivotably supported by the process frame such that the developing device is pivotable relative to the photosensitive drum, and a sealing member; and a toner cartridge detachably mountable on the drawer and configured to store toner, the toner cartridge comprising a toner casing having a toner discharge opening for discharging the toner, wherein the developing device comprises a developing casing having an opening configured to communicate with the toner discharge opening, and a developing roller rotatably supported by the developing casing, and wherein, when the process cartridge is mounted on the drawer and the toner cartridge is attached to the process cartridge, the sealing member is positioned between the opening of the developing casing and the toner discharge opening of the toner cartridge to provide sealing therebetween, and the developing device is pivotable relative to the toner cartridge.

21. The image-forming apparatus according to claim 20, wherein the toner cartridge further comprises a shutter movable relative to the toner discharge opening between an open position opening the toner discharge opening and a closed position closing the toner discharge opening, wherein the toner casing is movable relative to the drawer between a first position and a second position, either (1) when the process cartridge is mounted on the drawer and the toner cartridge is attached to the process cartridge, or (2) when the process cartridge is removed from the drawer and the toner cartridge is mounted on the drawer, wherein, when the process cartridge is mounted on the drawer and the toner cartridge is attached to the process cartridge, the shutter is at the closed position when the toner casing is at the first position, and the shutter is at the open position when the toner casing is at the second position, and wherein, when the process cartridge is removed from the drawer and the toner cartridge is mounted on the drawer, the shutter is maintained at the closed position both when the toner casing is at the first position and when the toner casing is at the second position.

22. The image-forming apparatus according to claim 21, wherein, when the process cartridge is mounted on the drawer and the toner cartridge is attached to the process cartridge, the shutter is fixed in position and immovable relative to the process cartridge.

23. The image-forming apparatus according to claim 22, wherein the shutter comprises a projection, wherein the process cartridge comprises a hole part for receiving the projection of the shutter, and wherein, when the process cartridge is mounted on the drawer and the toner cartridge is attached to the process cartridge, the projection is fitted in the hole part to fix the shutter in position relative to the process cartridge.

24. The image-forming apparatus according to claim 21, wherein the toner cartridge is locked and immovable relative to the drawer when the toner casing is at the second position, and wherein the toner cartridge is unlocked and movable relative to the drawer when the toner casing is at the first position.

25. An image-forming apparatus comprising:

a main casing;

a drawer movable in a first direction between an inner position and an outer position relative to the main casing, the drawer being accommodated in the main casing at the inner position, and at least a part of the drawer being located outside the main casing at the outer position;

a process cartridge detachably mountable on the drawer, the process cartridge comprising a photosensitive drum rotatable about a drum axis, the drum axis extending in a second direction crossing the first direction when the process cartridge is mounted on the drawer, a process frame rotatably supporting the photosensitive drum, a developing device movably supported by the process frame such that the developing device is movable relative to the photosensitive drum, and a sealing member; and a toner cartridge detachably mountable on the drawer and configured to store toner, the toner cartridge comprising a toner casing having a toner discharge opening for discharging the toner, wherein the developing device comprises a developing casing having an opening configured to communicate with the toner discharge opening, and a developing roller rotatably supported by the developing casing, and wherein, when the process cartridge is mounted on the drawer and the toner cartridge is attached to the process cartridge, the sealing member is positioned between the opening of the developing casing and the toner discharge opening of the toner cartridge to provide sealing therebetween, and the developing device is moveable relative to the toner cartridge.

26. The image-forming apparatus according to claim 25, wherein the toner cartridge further comprises a shutter movable relative to the toner discharge opening between an open position opening the toner discharge opening and a closed position closing the toner discharge opening, wherein the toner casing is movable relative to the drawer between a first position and a second position, either (1) when the process cartridge is mounted on the drawer and the toner cartridge is attached to the process cartridge, or (2) when the process cartridge is removed from the drawer and the toner cartridge is mounted on the drawer, wherein, when the process cartridge is mounted on the drawer and the toner cartridge is attached to the process cartridge, the shutter is at the closed position when the toner casing is at the first position, and the shutter is at the open position when the toner casing is at the second position, and wherein, when the process cartridge is removed from the drawer and the toner cartridge is mounted on the drawer, the shutter is maintained at the closed position both when the toner casing is at the first position and when the toner casing is at the second position.

27. The image-forming apparatus according to claim 26, wherein, when the process cartridge is mounted on the drawer and the toner cartridge is attached to the process cartridge, the shutter is fixed in position and immovable relative to the process cartridge.

28. The image-forming apparatus according to claim 27, wherein the shutter comprises a projection, wherein the process cartridge comprises a hole part for receiving the projection of the shutter, and wherein, when the process cartridge is mounted on the drawer and the toner cartridge is attached to the process cartridge, the projection is fitted in the hole part to fix the shutter in position relative to the process cartridge.

29. The image-forming apparatus according to claim 26, wherein the toner cartridge is locked and immovable relative to the drawer when the toner casing is at the second position, and wherein the toner cartridge is unlocked and movable relative to the drawer when the toner casing is at the first position.

* * * * *